US011356789B2

(12) United States Patent
Tamaki et al.

(10) Patent No.: US 11,356,789 B2
(45) Date of Patent: Jun. 7, 2022

(54) SIGNAL PROCESSING DEVICE, CHANNEL SETTING METHOD, AND SPEAKER SYSTEM

(71) Applicant: SONY CORPORATION, Tokyo (JP)

(72) Inventors: Tatsuya Tamaki, Kanagawa (JP); Yoshikazu Ohura, Kanagawa (JP); Kenji Yorimoto, Kanagawa (JP); Yosuke Samura, Kanagawa (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/980,973

(22) PCT Filed: Mar. 14, 2019

(86) PCT No.: PCT/JP2019/010683
§ 371 (c)(1),
(2) Date: Sep. 15, 2020

(87) PCT Pub. No.: WO2019/208012
PCT Pub. Date: Oct. 31, 2019

(65) Prior Publication Data

US 2021/0037331 A1 Feb. 4, 2021

(30) Foreign Application Priority Data

Apr. 24, 2018 (JP) ..... JP2018-082949

(51) Int. Cl.
*H04S 7/00* (2006.01)
*H04R 3/12* (2006.01)
(Continued)

(52) U.S. Cl.
CPC ..... *H04S 7/30* (2013.01); *H04R 3/12* (2013.01); *H04R 5/04* (2013.01); *H04S 3/002* (2013.01);
(Continued)

(58) Field of Classification Search
CPC ..... H04S 7/30; H04S 3/002; H04S 2400/01; H04S 2400/11; H04S 2420/01; H04R 3/12; H04R 5/04
See application file for complete search history.

(56) References Cited

U.S. PATENT DOCUMENTS 9,854,362 B1 12/2017 Milne et al.
2004/0151476 A1 8/2004 Suzuki
(Continued)

FOREIGN PATENT DOCUMENTS

CN 107277736 A 10/2017
CN 107396250 A 11/2017
(Continued)

OTHER PUBLICATIONS

International Search Report & Written Opinion of PCT Application No. PCT/JP2019/010683, dated Jun. 4, 2019, 09 pages of ISRWO.
(Continued)

*Primary Examiner* — Ping Lee
(74) *Attorney, Agent, or Firm* — Chip Law Group

(57) ABSTRACT

To enable channel setting to be performed easily and accurately to speakers. Thus, provided is a speaker system including: N number of speakers, the N being three or more; and a signal processing device capable of communicating with each speaker. The signal processing device performs processing of recognizing two arrangement reference speakers with reception of notification that a designation operation has been received from a user, from two speakers among the N number of speakers, and processing of acquiring distance information between each speaker. The signal processing device recognizes a relative-position relationship between the N number of speakers, with the two arrangement reference speakers and the distance information between each speaker. Then, the signal processing device automatically
(Continued)

sets a channel to each speaker, on the basis of the relative-position relationship recognized.

12 Claims, 19 Drawing Sheets

(51) Int. Cl.
*H04R 5/04* (2006.01)
*H04S 3/00* (2006.01)

(52) U.S. Cl.
CPC ..... *H04R 2420/07* (2013.01); *H04S 2400/01* (2013.01)

(56) References Cited

U.S. PATENT DOCUMENTS

| | | | | |
|---|---|---|---|---|
| 2014/0161265 | A1 | 6/2014 | Chaikin et al. | |
| 2014/0169569 | A1* | 6/2014 | Toivanen | H04R 5/04 381/17 |
| 2014/0362725 | A1* | 12/2014 | Hoffmann | H04W 24/02 370/254 |
| 2015/0381296 | A1 | 12/2015 | Jenq et al. | |
| 2016/0080884 | A1* | 3/2016 | Song | G10L 19/008 381/17 |
| 2016/0080886 | A1 | 3/2016 | De Bruijn et al. | |
| 2020/0186956 | A1 | 6/2020 | De Bruijn et al. | |
| 2021/0037331 | A1 | 2/2021 | Tamaki et al. | |
| 2021/0136512 | A1 | 5/2021 | De Bruijn et al. | |
| 2021/0144507 | A1 | 5/2021 | De Bruijn et al. | |

FOREIGN PATENT DOCUMENTS

| | | | |
|---|---|---|---|
| DE | 102015106114 | A1 | 10/2016 |
| EP | 1443804 | A2 | 8/2004 |
| JP | 05-122800 | A | 5/1993 |
| JP | 2002-345100 | A | 11/2002 |
| JP | 2004-241820 | A | 8/2004 |
| JP | 2017-184174 | A | 10/2017 |
| WO | 2006/131894 | A2 | 12/2006 |
| WO | 2007/028094 | A2 | 3/2007 |
| WO | 2012/164444 | A1 | 12/2012 |
| WO | 2019/208012 | A1 | 10/2019 |

OTHER PUBLICATIONS

Extended European Search Report of EP Application No. 19793355.9, dated May 28, 2021, 08 pages.

Office Action for CN Patent Application No. 201980020047.5, dated Nov. 12, 2021, 09 pages of English Translation and 14 pages of Office Action.

* cited by examiner

SIGNAL PROCESSING DEVICE, CHANNEL SETTING METHOD, AND SPEAKER SYSTEM

CROSS REFERENCE TO RELATED APPLICATIONS

This application is a U.S. National Phase of International Patent Application No. PCT/JP2019/010683 filed on Mar. 14, 2019, which claims priority benefit of Japanese Patent Application No. JP 2018-082949 filed in the Japan Patent Office on Apr. 24, 2018. Each of the above-referenced applications is hereby incorporated herein by reference in its entirety.

TECHNICAL FIELD

The present technology relates to a signal processing device, a channel setting method, a program, and a speaker system, and particularly relates to a technology of channel setting to each speaker.

BACKGROUND ART

For use of a surround audio system that connects a plurality of speakers, a user needs to set a channel to each speaker (output channel), correctly. However, a user who is usually unfamiliar with such a system has difficulty in understanding its setting method and thus often performs wrong channel setting.

For example, for a product that connects speakers with a master unit by wireless, a channel for each speaker is determined in advance and each speaker has a mark representing its determined channel in some cases. Examples of the marks include "FL" for the front left speaker, "FR" for the front right speaker, "SUR L" for the rear left speaker, and "SUR R" for the rear right speaker. Comparing such marks with the ideal layout of the speakers illustrated, for example, on the instruction manual, a user needs to arrange each speaker at the correct position in advance.

However, in a case where a user who is usually unfamiliar with such a system performs installation, if the user arranges the speakers freely with complete unawareness of the existence of the marks of the speakers or the existence of the ideal layout, wrong channel setting is performed. Furthermore, even if a user notices the marks or the ideal layout, in some cases, the user does not have the basic concept of "whether the speakers should be arranged on the basis of the left and right of oneself or on the basis of the left and right of the audio system. Thus, the user arranges the speakers at wrong positions, so that channel setting is often performed wrongly.

Moreover, as a method adopted mainly to a product that connects speakers with a master unit by wire, because the master unit has output terminals each having a mark representing a channel, sound cables that are connected with the speakers are connected to the correct channel output terminals of the master unit, so that speaker channel setting is performed. In this case, the marks of the output channels are more likely to be noticed, but the work of connecting a number of wiring lines to the correct speakers is intricate. Thus, channel setting is performed wrongly in some cases. Moreover, in some cases, a user who is unfamiliar with the concept of left and right of speaker layout in such a system performs channel setting wrongly because of a reason similar to the above.

Regarding channel setting to speakers, Patent Document 1 below has been also known.

CITATION LIST

Patent Document

Patent Document 1: Japanese Patent Application Laid-Open No. 2002-345100

SUMMARY OF THE INVENTION

Problems to be Solved by the Invention

Patent Document 1 discloses a technique in which, once a master unit and speakers are connected, a test tone is reproduced from each speaker at initial setup and an output channel is set to each speaker in order of test-tone reproduction.

However, in this case, channel setting needs to be performed manually to all the speakers in connection. Moreover, in some cases, a user who is unfamiliar with the concept of left and right of speaker layout in such a system performs channel setting wrongly because of a reason similar to the above.

Thus, an object of the present technology is to enable, in a case where a plurality of speakers is arranged like a surround system, facilitation of speaker channel setting and additionally even a user who is unfamiliar with such a system, to perform speaker channel setting accurately.

Solutions to Problems

A signal processing device according to the present technology includes: a relative-position recognition unit configured to perform processing of recognizing two arrangement reference speakers with reception of notification that a designation operation has been received from a user, from two speakers among N number of speakers, the N being three or more, and processing of acquiring distance information between each speaker, the relative-position recognition unit being configured to recognize a relative-position relationship between the N number of speakers, with the two arrangement reference speakers and the distance information between each speaker; and a channel setting unit configured to automatically set a channel to each speaker, on the basis of the relative-position relationship recognized by the relative-position recognition unit.

According to the present technology, a multichannel speaker system having three or more channels is assumed. Examples of the multichannel speaker system include a 5-channel surround audio system, a 7-channel surround audio system, and the like. The two speakers among the N number of speakers are detected by the notification of the designation operation of the user. Moreover, the relative-position relationship between each speaker is recognized with the distance information between the N number of speakers grasped.

It can be thought that the signal processing device according to the present technology, further includes a channel signal processing unit configured to perform signal processing to an input sound signal and generate N channels of sound signals to be supplied one to one to the N number of speakers, in which the channel signal processing unit generates the N channels of sound signals as transmission signals one to one to the speakers, on the basis of the channels set by the channel setting unit.

For example, in a 5-channel or 7-channel surround audio system, the channel signal processing unit generates a sound signal to each channel. The respective sound signals generated to the channels are allocated and transmitted one to one to the speakers, in accordance with channel assignment of each speaker by the channel setting unit.

It can be thought that, in the signal processing device according to the present technology, the N number of speakers each include an operation detection unit that detects a designation operation from the user, and the relative-position recognition unit issues an instruction for activation of the operation detection unit to each speaker, and additionally recognizes, as an arrangement reference speaker, a speaker having issued a notification of the operation detection unit having had detection during a period of activation.

Each speaker is provided with the operation detection unit including a sensing device of some kind, such as a touch sensor, a button, a microphone, or an optical sensor. The relative-position recognition unit of the signal processing device performs activation control such that the operation detection unit of each speaker is activated. In a case where an operation has been detected during the period of the activation, it is recognized that a designation operation has been received from the user.

It can be thought that, in the signal processing device according to the present technology, the relative-position recognition unit recognizes, as a front left speaker and a front right speaker, the two arrangement reference speakers that have received the notification that the designation operation has been received from the user.

As the arrangement reference speakers, determined are the front left speaker and the front right speaker arranged ahead of the face of the user at the time of listening.

It can be thought that, in the signal processing device according to the present technology, the relative-position recognition unit distinguishes the two arrangement reference speakers as the front left speaker and the front right speaker in order of the designation operations from the user.

Because either is recognized by detection of a user operation, the user is prompted to perform sequential operations. Then, the front left speaker and the front right speaker are determined in the order.

It can be thought that, in the signal processing device according to the present technology, the relative-position recognition unit issues, in a case where a first designation operation is performed by the user, the instruction for activation of the operation detection unit to each speaker different from a speaker having transmitted a notification of the first designation operation, and waits for a second designation operation.

At the point in time of receiving the notification of detection of the first designation operation, the speaker is controlled so as not to issue a notification of a designation operation.

It can be thought that, in the signal processing device according to the present technology, the relative-position recognition unit causes, for acquisition of the distance information between each speaker, each speaker sequentially to output a test sound.

One speaker is caused to output the test sound and the other speakers are caused to collect the test sound through the respective microphones. All the speakers are sequentially caused to output the test sound as described above.

It can be thought that, in the signal processing device according to the present technology, all the speakers are synchronized in time, each speaker includes a sound detection unit and is capable of transmitting detection time information regarding test sound from another speaker, and the relative-position recognition unit calculates, from output start time information regarding test sound from a speaker and detection time information from another speaker, a distance between the speaker and the another speaker.

Because all the speakers are synchronized in time, for example, the another speaker generates a file in which the test sound is recorded together with the time information, and transmits the file to the relative-position recognition unit.

It can be thought that the signal processing device according to the present technology, further includes a virtual speaker setting unit configure to set a virtual speaker arrangement, on the basis of the relative-position relationship recognized by the relative-position recognition unit and the channel setting performed by the channel setting unit.

A virtual speaker is a speaker virtually arranged in position differently from the actual speaker arrangement.

It can be thought that the signal processing device according to the present technology, further includes a channel signal processing unit configured to perform signal processing to an input sound signal and generate N channels of sound signals to be supplied one to one to the N number of speakers, in which the channel signal processing unit generates, in a case where the virtual speaker arrangement is set by the virtual speaker setting unit, the N channels of sound signals with which the virtual speaker arrangement is achieved, as transmission signals one to one to the speakers.

That is, the channel signal processing unit performs processing to the respective channel sound signals to be transmitted to the actual speakers such that the position of audio output and the localized state of each virtual speaker are achieved in accordance with the virtual speaker setting.

It can be thought that, in the signal processing device according to the present technology, the virtual speaker setting unit displaces position of the virtual speaker arrangement in a direction of rotation, in accordance with an operation signal.

For example, the position of the virtual speaker arrangement is displaced in the direction of left-handed rotation or in the direction of right-handed rotation, in accordance with a rotational operation in the direction of left-handed/right-handed rotation of the user.

It can be thought that the signal processing device according to the present technology, further includes a to-be-used speaker setting unit configured to control switching between audio output with the N number of speakers and audio output with part of the N number of speakers, in accordance with a user operation.

For example, designation of one speaker by the user with all the speakers in use causes only the one speaker to perform audio output.

A channel setting method according to the present technology, to be performed by a signal processing device, includes: recognizing two arrangement reference speakers with reception of notification that a designation operation has been received from a user, from two speakers among N number of speakers, the N being three or more; acquiring distance information between each speaker; recognizing a relative-position relationship between the N number of speakers, with the two arrangement reference speakers and the distance information between each speaker; and automatically setting a channel to each speaker, on the basis of the relative-position relationship recognized.

The signal processing device includes an information processing device, and the information processing device performs processing following the above steps.

A program according to the present technology causes the information processing device to perform such processing. This arrangement causes achievement of the channel setting method according to the present technology, in the signal processing device including the information processing device.

A speaker system according to the present technology includes the signal processing device and N number of speakers. This arrangement causes achievement of the speaker system easy and accurate for speaker arrangement and channel setting.

Effects of the Invention

The present technology enables easy and accurate channel setting to speakers. In particular, even a user who is unfamiliar with speaker systems can perform correct channel setting easily, so that proper audio output can be acquired.

Note that the effects described herein are not necessarily limitative and thus any of the effects in the present disclosure may be provided.

BRIEF DESCRIPTION OF DRAWINGS

FIGS. 13A, 13B, 13C, 13D, 13E, 13F, 13G and 13H are explanatory views of speaker arrangement direction changing according to the embodiment.

MODE FOR CARRYING OUT THE INVENTION

An embodiment will be described below in the following order.

<1. Speaker System Configuration>
<2. Channel Setting>
<3. Speaker Arrangement Changing>
<4. To-Be-Used Speaker Switching>
<5. Summary and Modifications>

1. Speaker System Configuration

According to the embodiment, assuming a surround audio system capable of connecting three or more speakers, channels are allowed to be set to the speakers easily.

An exemplary surround audio system with four speakers 3 (3A, 3B, 3C, and 3D) as in FIG. 1 will be described below.

Note that, in a case where the four speakers are given a collective term or in a case where distinction is not particularly made between the four speakers, the term "speaker 3" will be given. Moreover, in a case where the speakers are individually indicated, the terms "speaker 3A" to "speaker 3D" will be given.

As channels for the speakers 3, 4 channels are assumed and are defined as a front L channel, a front R channel, a surround L channel, and a surround R channel. The front L channel, the front R channel, the surround L channel, and the surround R channel are referred to as "FL channel", "FR channel", "SL channel", and "SR channel", respectively.

Needless to say, the 4 channels are exemplary for description. Thus, for example, 5 channels, 5.1 channels, 7 channels, or 7.1 channels can be thought.

In order to distinguish between respective channels set to the speakers, the front left speaker having the front L channel, the front right speaker having the front R channel, the rear left speaker having the surround L channel, and the rear right speaker having the surround R channel will be given the term "FL speaker", the term "FR speaker", the term "SL speaker", and the term "SR speaker", respectively.

For example, in a case where the speaker 3A is set to the front L channel, the term "FL speaker 3A" will be given, in some cases.

Figure 1:
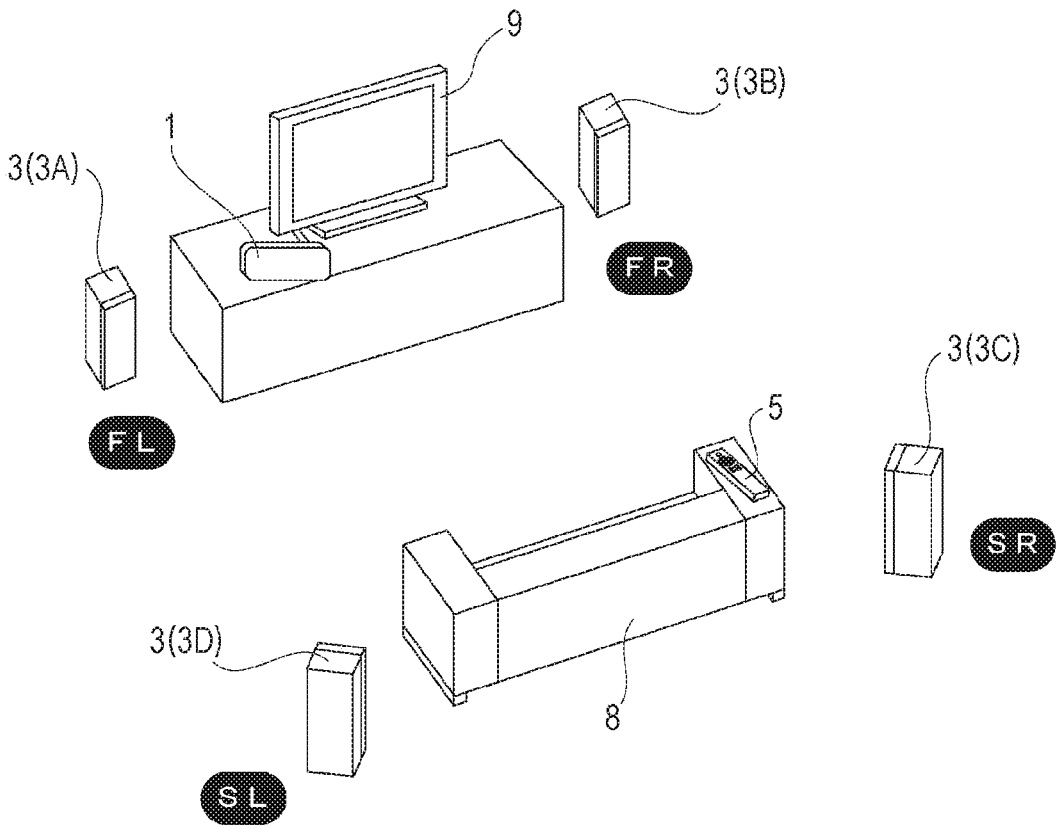
FIG. 1 is an explanatory view of an exemplary arrangement of a speaker system according to an embodiment of the present technology.

FIG. 1 illustrates an exemplary arrangement of the surround audio system, for example, in a living room.

The surround audio system according to the embodiment is provided as a speaker system including a signal processing device 1 and the speakers 3A, 3B, 3C, and 3D. Moreover, in some cases, the speaker system includes a remote controller 5.

Then, the speaker system is used in audio reproduction of video content that is displayed on a monitor device 9, for example, as a television receiver or the like. Alternatively, the speaker system is used in audio reproduction, such as music or environmental music, even in a case where the monitor device 9 does not perform video display.

The monitor device 9 is arranged in position on the front side of a user, for example, in front of a sofa 8. Then, in the example, the signal processing device 1 is arranged in proximity to the monitor device 9.

The FL speaker 3A and the FR speaker 3B are arranged on the left and the right of the monitor device 9, respectively.

Moreover, the SL speaker 3C and the SR speaker 3D are arranged on the rear left and the rear right of the sofa 8, respectively.

The arrangement above is a typical exemplary arrangement of the monitor device 9 and the 4-channel speaker system. Needless to say, the actual arrangement varies depending on, for example, the taste of the user, the arrangement of furniture, the size of the room, or the shape of the room. Basically, the speakers 3A, 3B, 3C, and 3D are preferably arranged in suitable position as the FL channel, the FR channel, the SL channel, and the SR channel.

Figure 2:
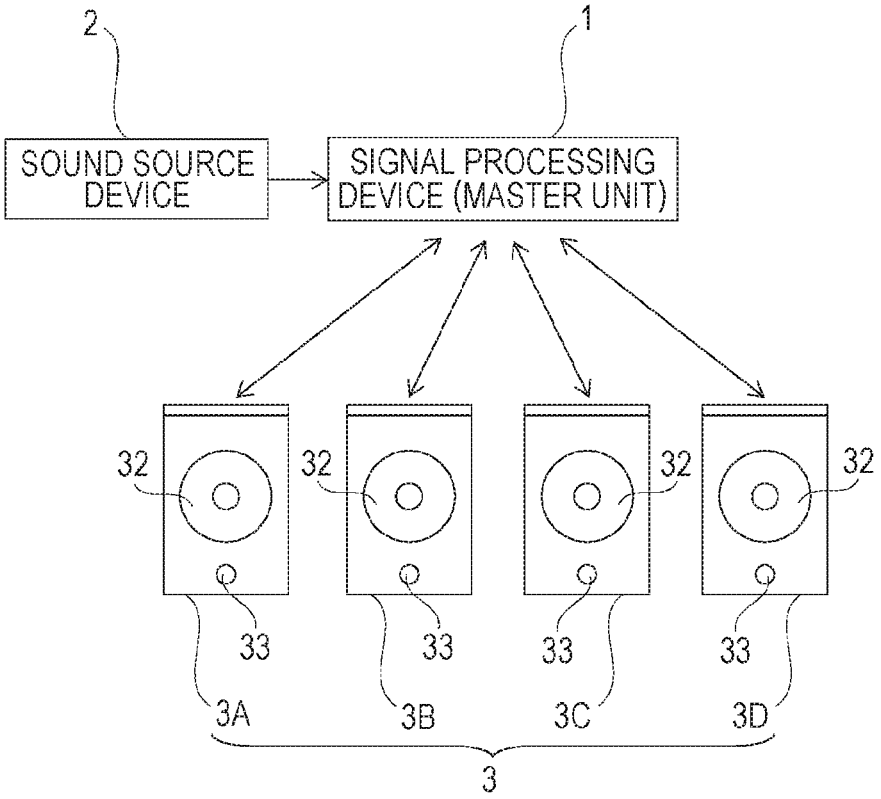
FIG. 2 is an explanatory diagram of the equipment configuration of the speaker system according to the embodiment.

FIG. 2 illustrates an exemplary configuration of the speaker system according to the embodiment.

The speaker system enables communication between the signal processing device 1 as a master unit and the speakers 3A, 3B, 3C, and 3D as slave units.

Note that, for example, wireless communication in a communication scheme, such as Wi-Fi (registered trademark) or Bluetooth (registered trademark), may be performed between the signal processing device 1 and each speaker 3. Alternatively, for example, local area network (LAN) communication, universal serial bus (USB) communication, or the like may be performed between the signal processing device 1 and each speaker 3 in wired connection. Needless to say, connections may be made with dedicated cables including audio cables and control cables.

For example, a sound signal (digital sound signal or analog sound signal), control data, or notification data is transmitted between the signal processing device 1 and the speakers 3 by such wireless communication or wired communication. Moreover, the speakers 3A, 3B, 3C, and 3D each are synchronized in time, for example, through the signal processing device 1.

The speakers 3A, 3B, 3C, and 3D may be capable of communicating with each other. Alternatively, it can be thought that the speakers 3A, 3B, 3C, and 3D do not particularly communicate with each other.

The speakers 3A, 3B, 3C, and 3D are subjected to channel setting (channel assignment) by the signal processing device 1.

The speakers 3A, 3B, 3C, and 3D each have an individual speaker ID, for example, as an identifier. Basically, the speakers 3A, 3B, 3C, and 3D each are identical in configuration and are not necessarily a dedicated device to a certain channel. For example, the speaker 3A can be used as any of the FL speaker, the FR speaker, the SL speaker, and the SR speaker. The other speakers 3B, 3C, and 3D can be used, similarly.

Therefore, without being conscious of the distinction between the speakers 3A, 3B, 3C, and 3D, the user is only required to arrange the speakers 3A, 3B, 3C, and 3D in position around the user, for example, as in FIG. 1.

Each speaker 3 is subjected to channel assignment by the signal processing device 1 as described later, so that a channel is determined to each speaker 3 with the signal processing device 1 as the base.

The signal processing device 1 inputs a sound signal from a sound source device 2 thereto and performs necessary signal processing to the sound signal. Then, the signal processing device 1 transmits the respective sound signals allocated to the channels to the corresponding assigned speakers 3. Each speaker 3 receives the corresponding channel sound signal from the signal processing device 1 and performs sound output. This arrangement causes performance of 4-channel surround audio output.

The sound source device 2 illustrated in FIG. 2 is, for example, the monitor device 9, a reproduction device (audio player) not illustrated, or the like.

The sound source device 2 supplies a sound signal having an L-and-R stereo channel (digital sound signal or analog sound signal) or a multichannel-surround-enabled sound signal to the signal processing device 1.

The signal processing device 1 allocates or generates sound signals to the channels corresponding to the installed speakers 3. In the example, sound signals are generated to the FL channel, the FR channel, the SL channel, and the SR channel, and then are transmitted to the corresponding speakers 3A, 3B, 3C, and 3D.

Each speaker 3 includes a speaker unit 32, and performs sound output with the speaker unit 32 driven by the transmitted sound signal.

Note that each speaker 3 includes a microphone 33 that can be used in channel setting to be described later.

Figure 3:
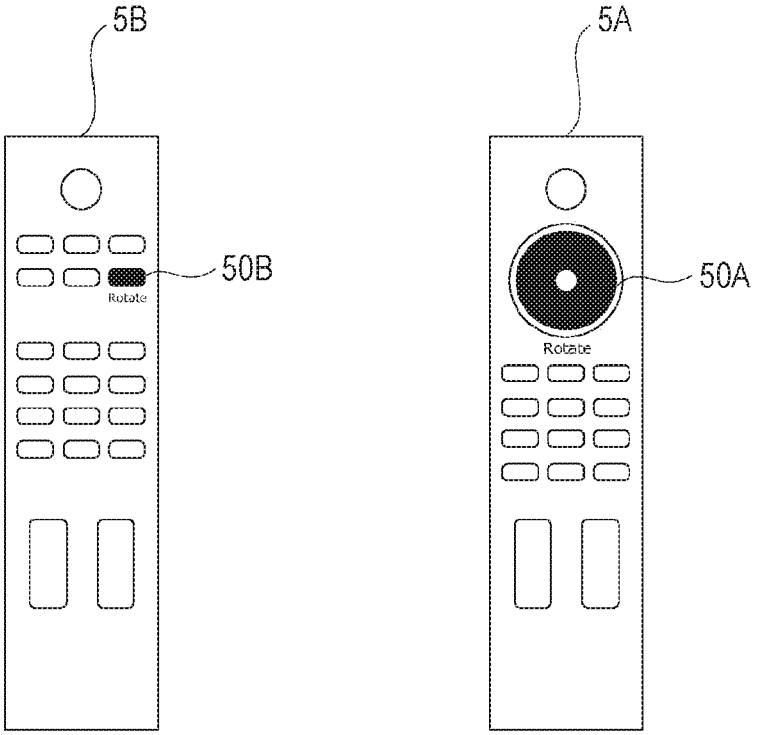
FIG. 3 is an explanatory view of remote controllers to be used in the speaker system according to the embodiment.

FIG. 3 illustrates remote controllers 5A and 5B as examples of the remote controller 5. For example, with infrared rays or radio waves, the remote controllers 5A and 5B each transmit operation information by the user to the signal processing device 1.

According to the present embodiment, the remote controllers 5A and 5B include respective operators 50 (50A and 50B) for rotational operation. The operator 50A is, for example, a rotary encoder capable of transmitting information regarding the amount of rotational operation. The operator 50B is a button capable of issuing an instruction for a predetermined angle of rotation, for example, by a single press operation.

Use of the operators 50 for rotational operation will be described in detail later.

Figure 4:
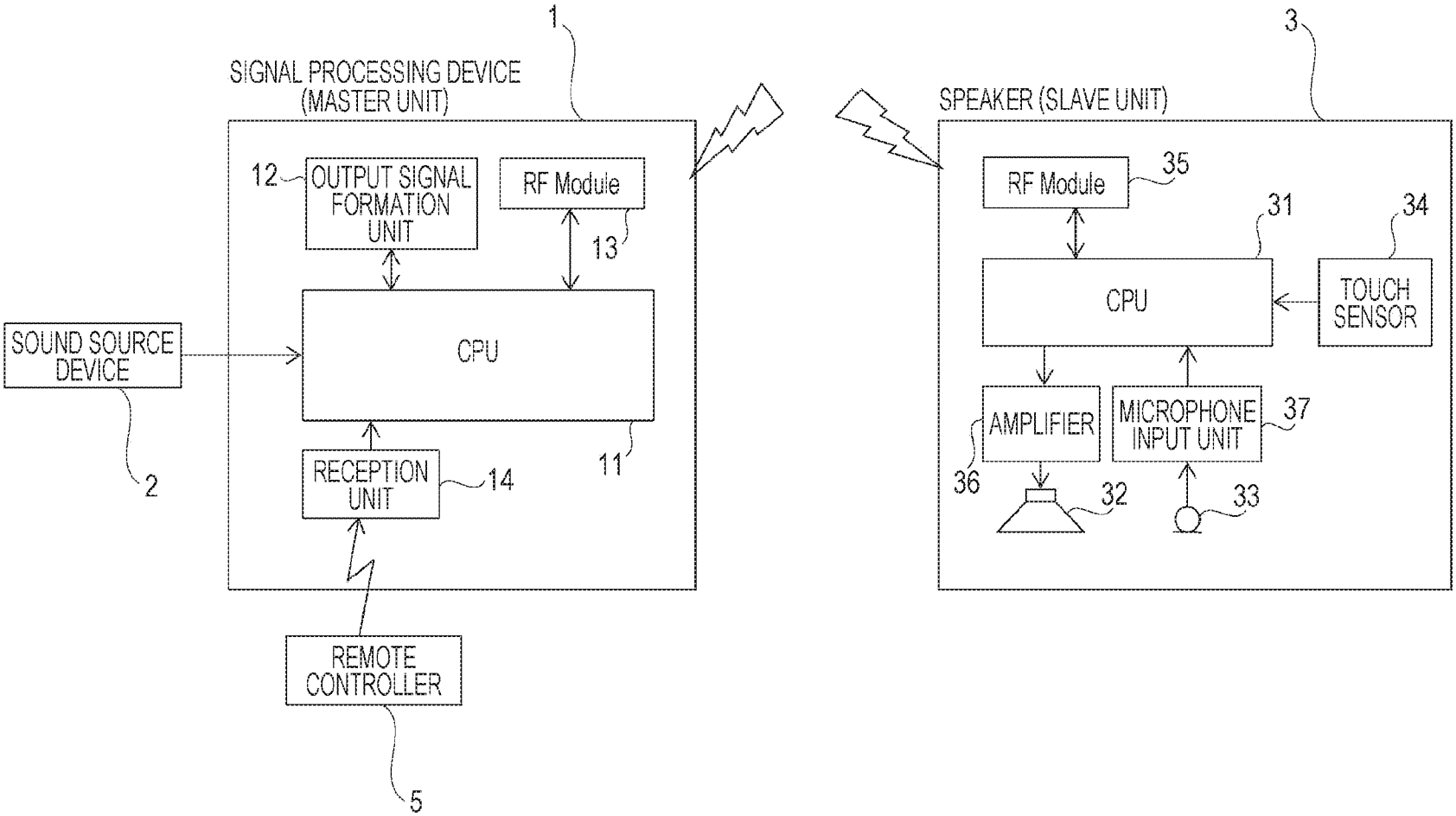
FIG. 4 is a block diagram of the respective internal configurations of a signal processing device and a speaker according to the embodiment.

Referring to FIG. 4, the internal configurations of the signal processing device 1 and the speakers 3 will be described. Note that the description will be given below on condition that wireless communication is performed between the signal processing device 1 and the speakers 3.

In wireless communication, each speaker 3 that is a slave unit is capable of identifying communication to itself from a slave address given to itself.

Moreover, each speaker 3 causes transmission information to include its identifier (speaker ID), so that the signal processing device 1 can identify from which speaker 3 communication has come from.

The signal processing device 1 includes a central processing unit (CPU) 11, an output signal formation unit 12, a radio frequency (RF) module 13, and a reception unit 14.

The output signal formation unit 12 performs processing regarding a sound signal to be output to each speaker 3. For example, the output signal formation unit 12 in cooperation with the CPU 11 performs allocation of a sound signal to each channel or generation processing of a channel sound signal, generation processing of a sound signal to each speaker for virtual speaker output to be described later, such as signal processing including, for example, channel mixing, adjustment in localization, and delay. Moreover, the output signal formation unit 12 performs, for example, amplification processing, tone processing, equalizing, or band-pass filtering processing to the sound signal of each channel.

Moreover, in some cases, the output signal formation unit 12 performs processing of generating a sound signal as a test tone to be used in channel setting.

An RF module 13 transmits a sound signal and a control signal to each speaker 3 or receives a signal from each speaker 3.

Thus, the RF module 13 performs encoding processing for wireless transmission and transmission processing to a sound signal and a control signal to be transmitted, supplied from the CPU 11. Moreover, the RF module 13 performs, for example, reception processing to signals transmitted from the speakers 3, decoding processing to reception data, and transfer to the CPU 11.

The reception unit 14 receives an operation signal from the remote controller 5, demodulates/decodes the received operation signal, and transmits the operation information to the CPU 11.

The CPU 11 performs, for example, arithmetic processing to a sound signal supplied from the sound source device 2, channel setting processing, or processing regarding virtual speakers.

Figure 5:
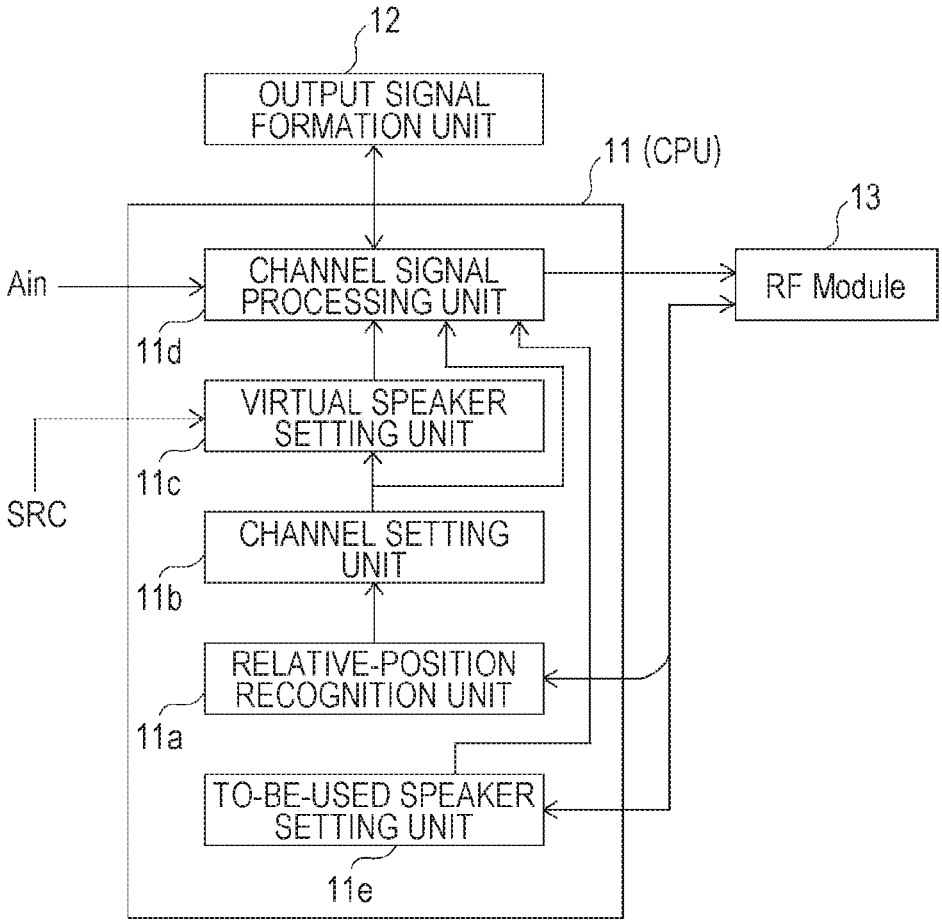
FIG. 5 is an explanatory diagram of the functional configuration of the signal processing device according to the embodiment.

According to the present embodiment, the CPU 11 is provided with functions illustrated in FIG. 5 by an implemented program (software), and performs arithmetic processing as the functions. That is, the CPU 11 has functions as a relative-position recognition unit 11*a*, a channel setting unit 11*b*, a virtual speaker setting unit 11*c*, a channel signal processing unit 11*d*, and a to-be-used speaker setting unit 11*e*.

The relative-position recognition unit 11*a* and the channel setting unit 11*b* perform processing for channel setting to each speaker 3 to be described later.

The relative-position recognition unit 11*a* performs processing of recognizing two arrangement reference speakers with reception of notification that a designation operation has been received from the user, from two speakers 3 among N number of speakers 3 installed (N is four in the present example). Moreover, the relative-position recognition unit 11*a* performs processing of acquiring distance information between each speaker 3. Furthermore, the relative-position recognition unit 11*a* performs processing of recognizing the relative-position relationship between the N number of (four) speakers 3, with the two arrangement reference speakers and the distance information between each speaker.

The channel setting unit 11*b* performs processing of automatically setting a channel to each speaker 3, on the basis of the relative-position relationship recognized by the relative-position recognition unit.

The processing of the relative-position recognition unit 11*a* and the processing of the channel setting unit 11*b* will be described in detail later as channel setting processing.

The virtual speaker setting unit 11*c* performs processing of setting a virtual speaker arrangement, on the basis of the relative-position relationship recognized by the relative-position recognition unit 11*a* and the channel setting performed by the channel setting unit 11*b*. A virtual speaker is a speaker virtually arranged in position differently from the arrangement of an actual speaker 3. Setting virtual speakers by the virtual speaker setting unit 11*c* includes applying predetermined processing to a sound signal to each speaker 3 and performing audio output localized in position differently from the arrangement of the actual speakers 3.

Moreover, for example, in a case where the user performs an operation of changing the virtual speaker position in the direction of rotation through the remote controller 5, the virtual speaker setting unit 11*c* performs processing of changing the virtual speaker arrangement, in accordance with the operation.

Specific processing of the function as the virtual speaker setting unit 11*c* will be given in the following description of channel setting or the description of speaker arrangement changing.

In cooperation with signal processing in the output signal formation unit 12, the channel signal processing unit 11*d* performs processing of generating N channels of sound signals to be supplied one to one to the N number of speakers 3, on the basis of an input sound signal, and transferring the N channels of sound signals to the RF module 13.

Moreover, in a case where a virtual speaker arrangement is set by the virtual speaker setting unit 11*c*, the channel signal processing unit 11*d* in cooperation with the output signal formation unit 12 performs processing of generating, as respective transmission signals to the speakers 3, the N channels of sound signals processed so as to be localized for achievement of virtual speakers.

In accordance with a user operation, the to-be-used speaker setting unit 11*e* performs processing of controlling switching between audio output with the N number of speakers 3 and audio output with part of the N number of speakers.

For example, designation of one speaker by the user with all the speakers in use causes only the one speaker to perform audio output. Specifically, the to-be-used speaker setting unit 11*e* delivers information regarding a to-be-used speaker, to the channel signal processing unit 11*d*. Then, the channel signal processing unit 11*d* performs, for example, generation of a to-be-used channel sound signal and mute control to a not-to-be-used channel such that audio output is performed by only the to-be-used speaker.

The information regarding a to-be-used speaker as a user operation is detected, for example, by reception of information from the corresponding speaker 3 through the RF module 13. Needless to say, in a case where the user performs an operation of designating a to-be-used speaker through the remote controller 5, the to-be-used speaker setting unit 11*e* may perform processing in accordance therewith.

Exemplary specific processing of the function as the to-be-used speaker setting unit 11*e* will be given in the description of to-be-used speaker switching.

Referring back to FIG. 4, the configuration of the speaker 3 will be described.

The speaker 3 includes a CPU 31, a speaker unit 32, a microphone 33, a touch sensor 34, an RF module 35, an amplifier 36, and a microphone input unit 37.

The CPU 31 performs communication processing or speaker internal control.

The RF module 35 performs wireless communication with the RF module 13 of the signal processing device 1. The RF module 35 receives a sound signal and a control signal transmitted from the signal processing device 1 and performs decoding processing to the sound signal and the control signal. Then, the RF module 35 transfers the decoded signals to the CPU 31.

Moreover, the RF module 35 also performs processing of encoding, for wireless transmission, to a control signal and a notification signal transferred from the CPU 31 and transmitting the encoded signals to the signal processing device 1.

The CPU 31 supplies a sound signal transmitted from the signal processing device 1 to the amplifier 36.

The amplifier 36 converts the sound signal, for example, as digital data, transferred from the CPU 31, into an analog signal and amplifies the analog signal. The amplifier 36 outputs the amplified signal to the speaker unit 32. This arrangement causes audio output to be performed from the speaker unit 32.

Note that, in a case where the speaker unit 32 is directly driven by digital sound data, the amplifier 36 is only required to output a digital sound signal.

The microphone 33 collects external sound. The microphone input unit 37 amplifies a sound signal acquired by the microphone 33, and converts the amplified signal into, for example, digital sound data. Then, the microphone input unit 37 supplies the digital sound data to the CPU 31.

The CPU 31 is capable of storing, as a microphone input sound signal, a sound signal together with time information (time stamp), for example, in an internal random access memory (RAM). Alternatively, in a case where a specific sound signal is detected as a test sound to be described later, the CPU 31 may store only time information without storing the sound signal.

The CPU 31 transfers the stored information to the RF module 35 with predetermined timing and causes the RF module 35 to transmit the transferred information to the signal processing device 1.

The touch sensor 34 is a contact detection sensor, for example, as a touch pad or the like formed at a position that the user can touch easily, such as the upper face or front face of the casing of the speaker 3.

The touch sensor 34 detects a touch operation of the user, so that detection information is transmitted to the CPU 31.

In a case where it is detected that a touch operation has been performed, the CPU 31 causes the RF module 35 to transmit detection information regarding the touch operation, to the signal processing device 1.

Note that the touch sensor 34 is an exemplary device that detects an operation of the user to the speaker 3. Instead of the touch sensor 34 or in addition to the touch sensor 34, a device capable of detecting an operation or action of the user may be provided, such as an image pickup device (camera), an operation button, or a capacitive sensor.

Moreover, an example can be thought in which the microphone 33 detects a sound due to a touch operation (sound of contact) without providing the touch sensor 34 or the like.

2. Channel Setting

Channel setting according to the present embodiment that is performed with the configuration above, will be described.

Note that, for simplification of description, each speaker 3 is defined as being arranged on the same plane.

In a case where a user manually sets speaker output channels at the time of setup of a speaker system, in some cases, setting is performed wrongly. Moreover, there are some users who do not understand channel setting work or some users who think channel setting work troublesome. In such cases, it is difficult to reproduce correct surround sound.

According to the present embodiment, the user only touches some speakers 3, so that output channels can be set to all the speakers 3, correctly.

Referring to FIGS. 6A, 6B, 7A, 7B, 8A, and 8B, 9A and 9B, steps of channel setting will be described.

Figure 6A:
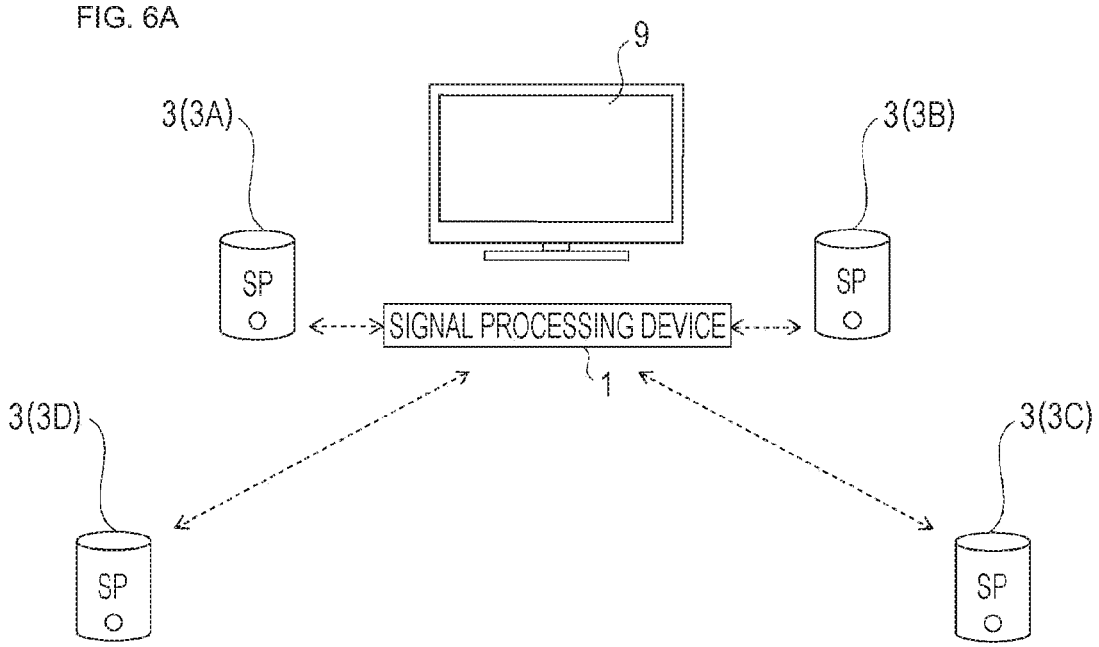
FIGS. 6A and 6B are explanatory views of channel setting steps according to the embodiment.

FIG. 6A illustrates the state where the signal processing device 1 and the four speakers 3A, 3B, 3C, and 3D are installed, for example, as described with FIG. 1.

For the speaker system according to the present embodiment, because channel setting to each speaker 3 is not determined in advance, the user installs the speakers 3A, 3B, 3C, and 3D at any positions without caring about channel setting. Rightfully, each speaker 3 has not been subjected to channel setting.

In this state, supply of power to the signal processing device 1 that is the master unit and each speaker 3 causes wireless communication connection between the signal processing device 1 and each speaker 3, for example, by WiFi or the like as illustrated, resulting in a start of initial setup.

Figure 6B:
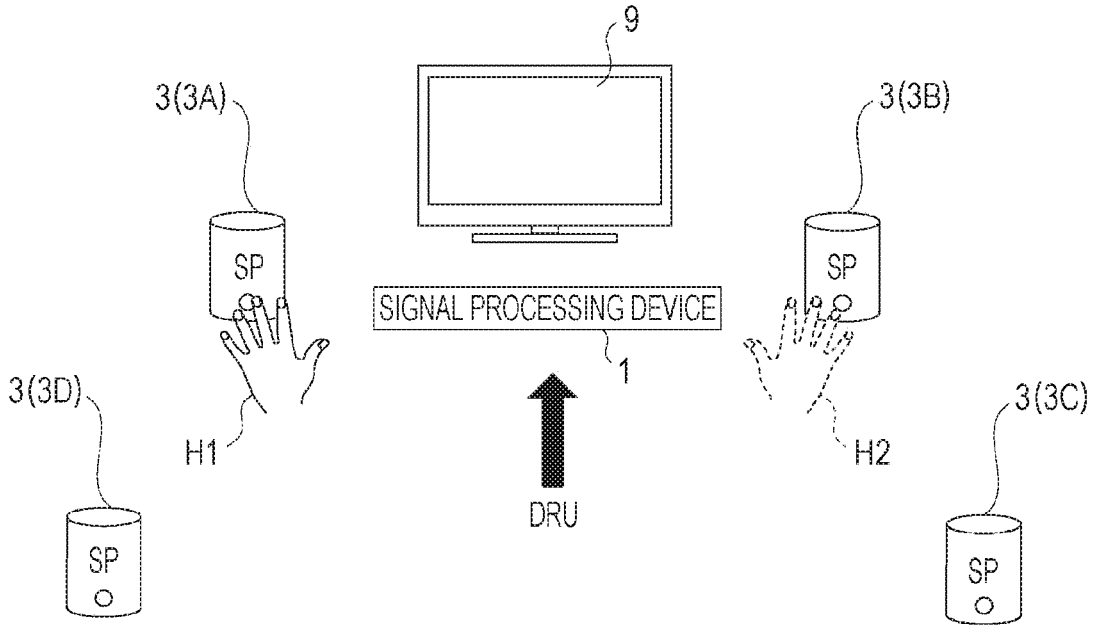

After the initial setup starts, in accordance with the guidance of the present speaker system, the user touches the speaker 3A placed on the left of the monitor device 9 as indicated with solid line H1 in FIG. 6B and subsequently touches the speaker 3B placed on the right of the monitor device 9 as indicated with broken line H2.

For example, as a guidance, the speaker system may provide a guide sound, such as "Please touch the speaker on the left facing the front" or may display the message on the monitor device 9.

In accordance with the guidance, the user performs an operation of touching the touch sensor 34 of the speaker 3A on the left facing ahead (arrow DRU). In general, the direction in which the user faces the monitor device 9 is the front.

After it is detected that the user has performed, for example, an operation of touching the touch sensor 34 of the speaker 3A, subsequently, the speaker system provides a guidance of the content "Please touch the speaker on the right facing the front".

In accordance with the guidance, the user subsequently performs an operation of touching the touch sensor 34 of the speaker 3B.

Note that it can be assumed that a user does not use the monitor device 9. Such a user is only required to touch the front left speaker and the front right speaker in sequence, meeting the position and the direction that the user usually listens at and in.

Figure 7A:
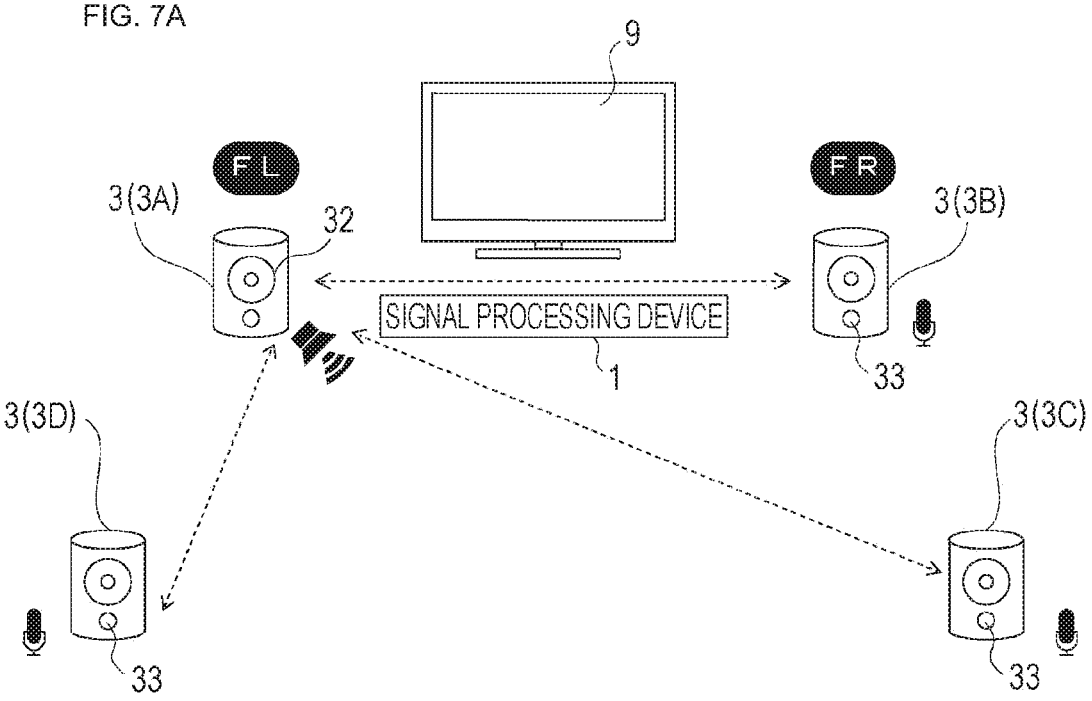
FIGS. 7A and 7B are explanatory views of channel setting steps according to the embodiment.

As described above, after the user touches the two speakers 3A and 3B in sequence, the speaker system sets the speakers 3A and 3B as the FL speaker and the FR speaker. FIG. 7A illustrates the state where the speakers 3A and 3B are set as the FL speaker and the FR speaker.

By this point in time, the speaker system can specify the FL speaker 3A and the FR speaker 3B and additionally can estimate the orientation of the user at the time of listening as the relative-position relationship to the set FL speaker 3A and FR speaker 3B.

Subsequently, the speaker system automatically measures the distance between each speaker 3. For example, with a precision time protocol (PTP) scheme, synchronization in time is made in advance between the signal processing device 1 that is the master unit and each speaker 3.

For measurement in distance between the speakers 3, a test sound reproduced by one speaker 3 is detected by the other speakers 3, and arrival times of the sound are measured.

For example, as illustrated in FIG. 7A, a test sound reproduced by the speaker unit 32 of the FL speaker 3A is picked up by the respective microphones 33 with which the FR speaker 3B and the speakers 3C and 3D are equipped, so that each picked-up test sound is stored together with a time stamp (time information).

In this case, from the differences between reproduction time information regarding the speaker 3A on the reproduction side and the respective pieces of time information stored in the other speakers 3B, 3C, and 3D, the distance between the speakers 3A and 3B, the distance between the speakers 3A and 3C, and the distance between the speakers 3A and 3D indicated with broken lines can be measured.

As the test sound, for example, an electronic sound having a predetermined frequency needs at least outputting for a moment. Needless to say, a sound continuing, for example, for one second or for a few seconds, may be provided. In any case, a sound needs at least measurement of arrival time.

Such an operation is performed with a speaker 3 for reproduction changed.

That is, as in FIG. 7A, the speaker 3A reproduces a test sound, and the speakers 3B, 3C, and 3D each store the test sound and time information. Subsequently, as in FIG. 7B, the speaker unit 32 of the speaker 3B reproduces a test sound. Then, the respective microphones 33 of the speakers 3A, 3C, and 3D pick up the test sound, and then the speakers 3A, 3C, and 3D each store the test sound and time information. This arrangement causes measurement of the distance between the speakers 3B and 3A, the distance between the speakers 3B and 3C, and the distance between the speakers 3B and 3D indicated with broken lines.

Furthermore, although not illustrated, subsequently, the speaker 3C reproduces a test sound, and the speakers 3A, 3B, and 3D each store the test sound and time information. This arrangement causes measurement of the distance between the speakers 3C and 3A, the distance between the speakers 3C and 3B, and the distance between the speakers 3C and 3D.

Moreover, subsequently, the speaker 3D reproduces a test sound, and the speakers 3A, 3B, and 3C each store the test sound and time information. This arrangement causes measurement of the distance between the speakers 3D and 3A, the distance between the speakers 3D and 3B, and the distance between the speakers 3D and 3C.

As a result, the distances between all combinations of the speakers 3 can be measured.

Note that reproduction/storage of test sounds as above enables two times of measurement of time difference (distance) in one combination. Preferably, the average of two times of measurement is acquired to reduce measurement error.

Moreover, for further efficiency of initial setup, the processing of reproduction/storage of test sounds may finish at the point in time of completion of measurement in all the combinations. In the above example, for example, reproduction of a test sound from the speaker 3D may be omitted. Furthermore, in this case, any speaker 3 that has already performed reproduction does not necessarily perform the processing of storage. For example, the speaker 3A enables measurement of the respective distances to the speakers 3B, 3C, and 3D from the speaker 3A after the finish of reproduction of the speaker 3A. Thus, the speaker 3A does not necessarily perform storage at the time of reproduction of a test sound from each of the speakers 3B and 3C. Similarly, the speaker 3B does not necessarily perform storage at the time of reproduction of a test sound from the speaker 3C.

After measurement of the distances between all the speakers 3 finishes, the positional relationship between each speaker 3 is determined.

Figure 8A:
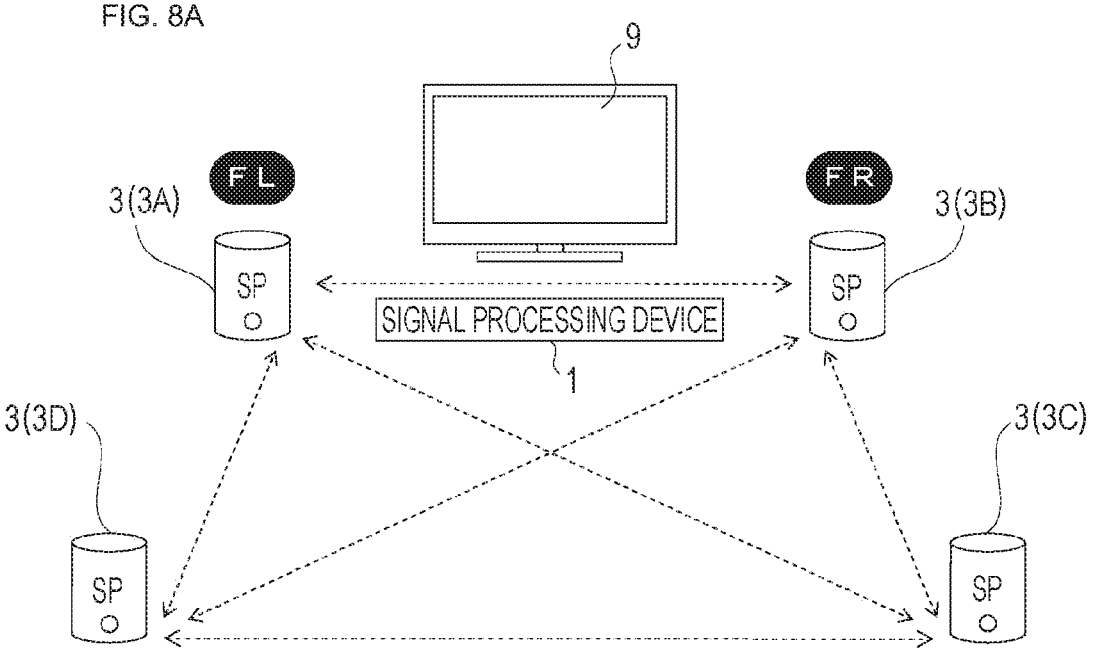
FIGS. 8A and 8B are explanatory views of channel setting steps according to the embodiment.
Figure 8B:
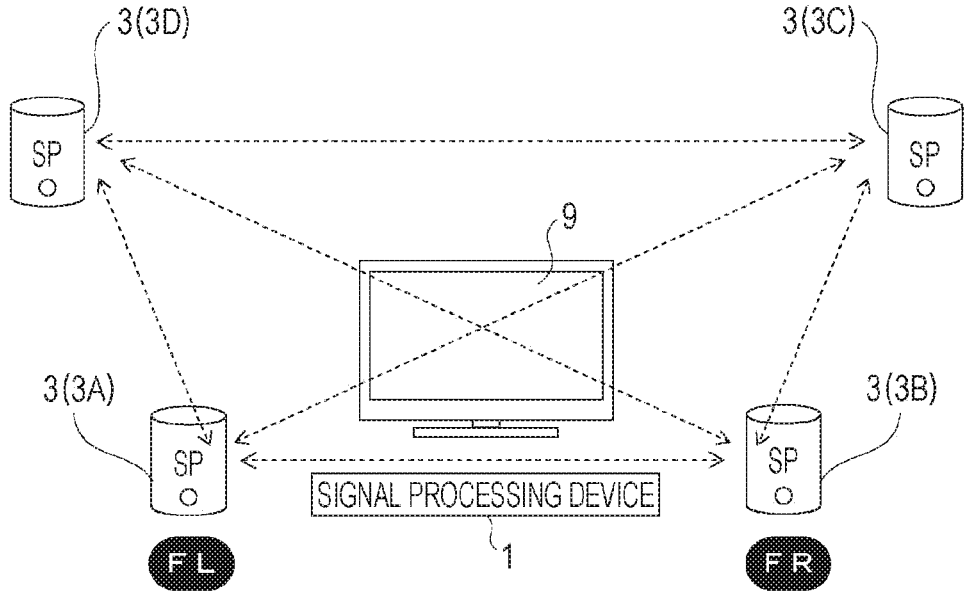

That is, from the distance between each speaker 3, the signal processing device 1 can grasp either the arrangement state in FIG. 8A or the arrangement state in FIG. 8B. The arrangement in FIG. 8A and the arrangement in FIG. 8B are in the relationship between mirror images identical in the distance between each speaker 3.

Then, because the FL speaker 3A and the FR speaker 3B have already been specified, the speakers 3A and 3B are on the front side. Therefore, the signal processing device 1 can specify that the arrangement state in FIG. 8A is actual one.

That is, supposing that the remaining speakers 3 to the FL speaker 3A and the FR speaker 3B are located behind the user, the possibility of the speaker arrangement in FIG. 8B can be eliminated.

From the relative-position relationship between each speaker 3 determined in this manner (FIG. 8A) and the estimated orientation of the user, the signal processing device 1 automatically sets channels (SL and SR) to all the remaining speakers.

Figure 9A:
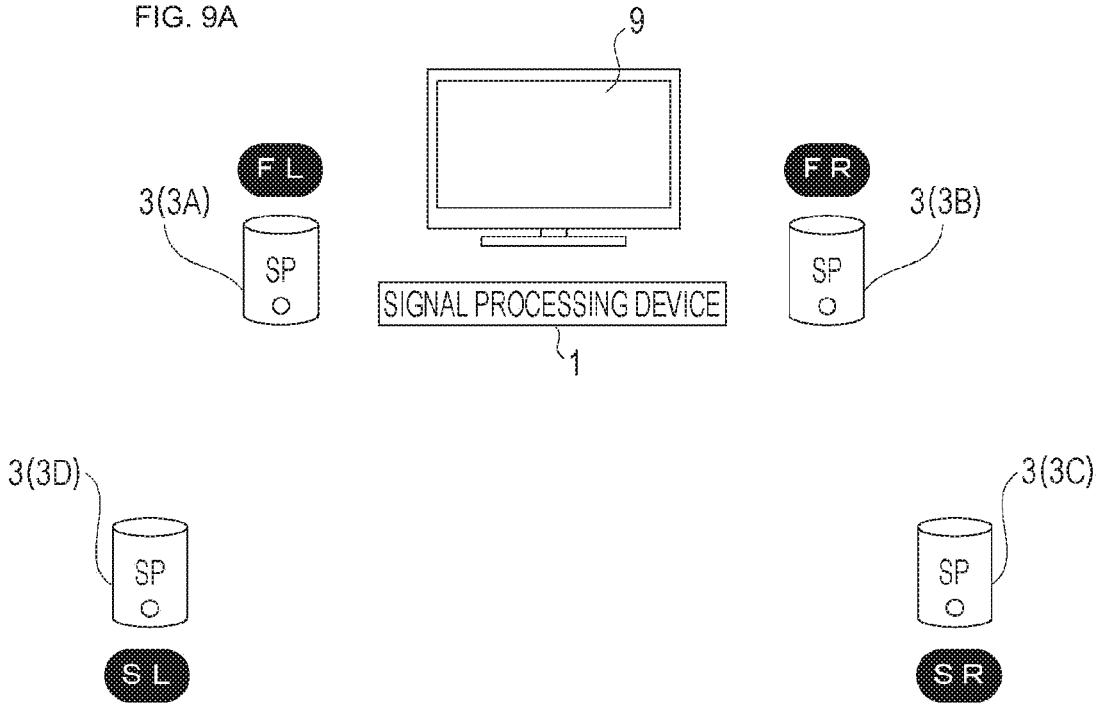
FIGS. 9A and 9B are explanatory views of a channel setting step and virtual speaker setting according to the embodiment.

That is, as illustrated in FIG. 9A, the SR channel and the SL channel are automatically set to the speaker 3C and the speaker 3D, respectively.

As a result, the signal processing device 1 has set the FL speaker 3A, the FR speaker 3B, the SR speaker 3C, and the SL speaker 3D. That is, the FL channel, the FR channel, the SL channel, and the SR channel have been assigned to the four speakers 3 arranged arbitrarily, in accordance with the respective arrangement positions.

Note that, for example, there is a technology of generating a virtual speaker at an arbitrary position as if a sound comes out from the position, disclosed in U.S. Pat. No. 9,749,769.

Figure 9B:
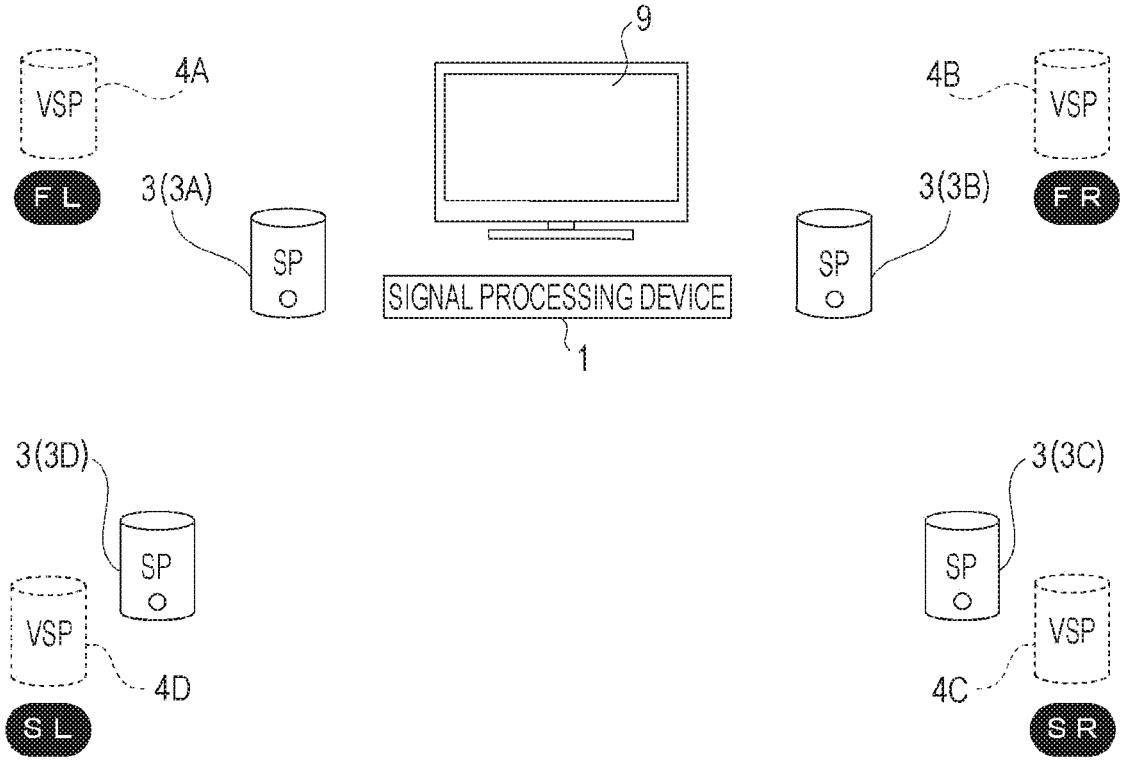

Use of such a technology enables generation of virtual speakers 4 (4A, 4B, 4C, and 4D) at positions different from those of the real speakers 3A, 3B, 3C, and 3D and allocation of channels to the generated virtual speakers 4A, 4B, 4C, and 4D, as illustrated in FIG. 9B.

Moreover, for further simplification, localization control with the mixing ratio of each channel sound signal or delay time setting corresponding to the difference in position between the set virtual speakers 4 and the real speakers 3 enables creation of an audio space in which sound is audible from the positions of the virtual speakers 4A, 4B, 4C, and 4D although the sound is actually output from the speakers 3A, 3B, 3C, and 3D.

Such virtual speaker setting enables achievement of a further surround audio environment even in a case where a speaker arrangement that is not necessarily proper is made as a surround audio system (or even in a case where no proper arrangement can be made because of the condition of the room).

Thus, after channel setting of the speakers 3 is performed as above at the time of initial setup, virtual speaker setting may be performed sequentially.

Processing of the signal processing device 1 and processing of the speakers 3 for achievement of the above channel setting, will be described with FIGS. 10 and 11.

Figure 10:
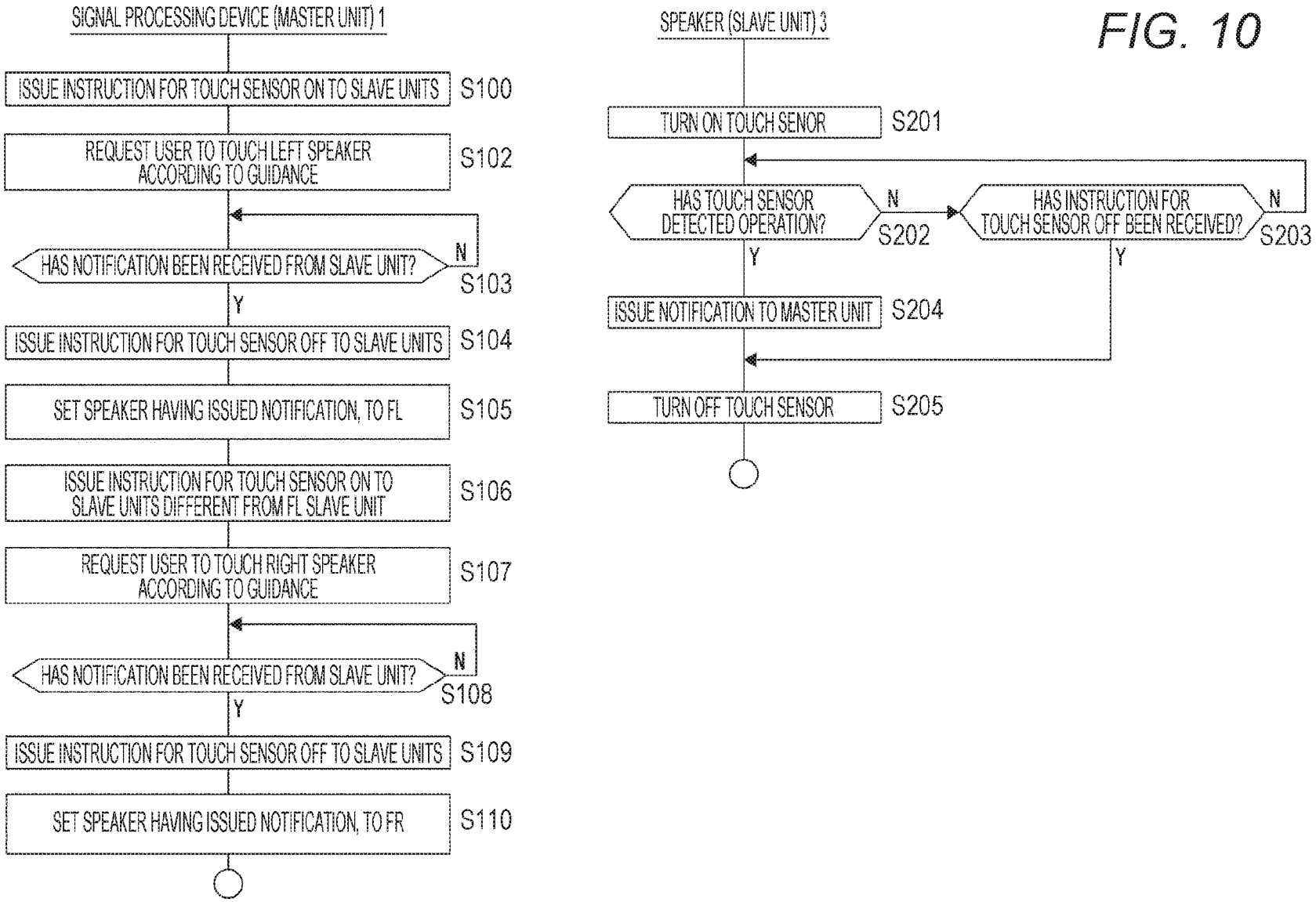
FIG. 10 is a flowchart of channel setting processing according to the embodiment.
Figure 11:
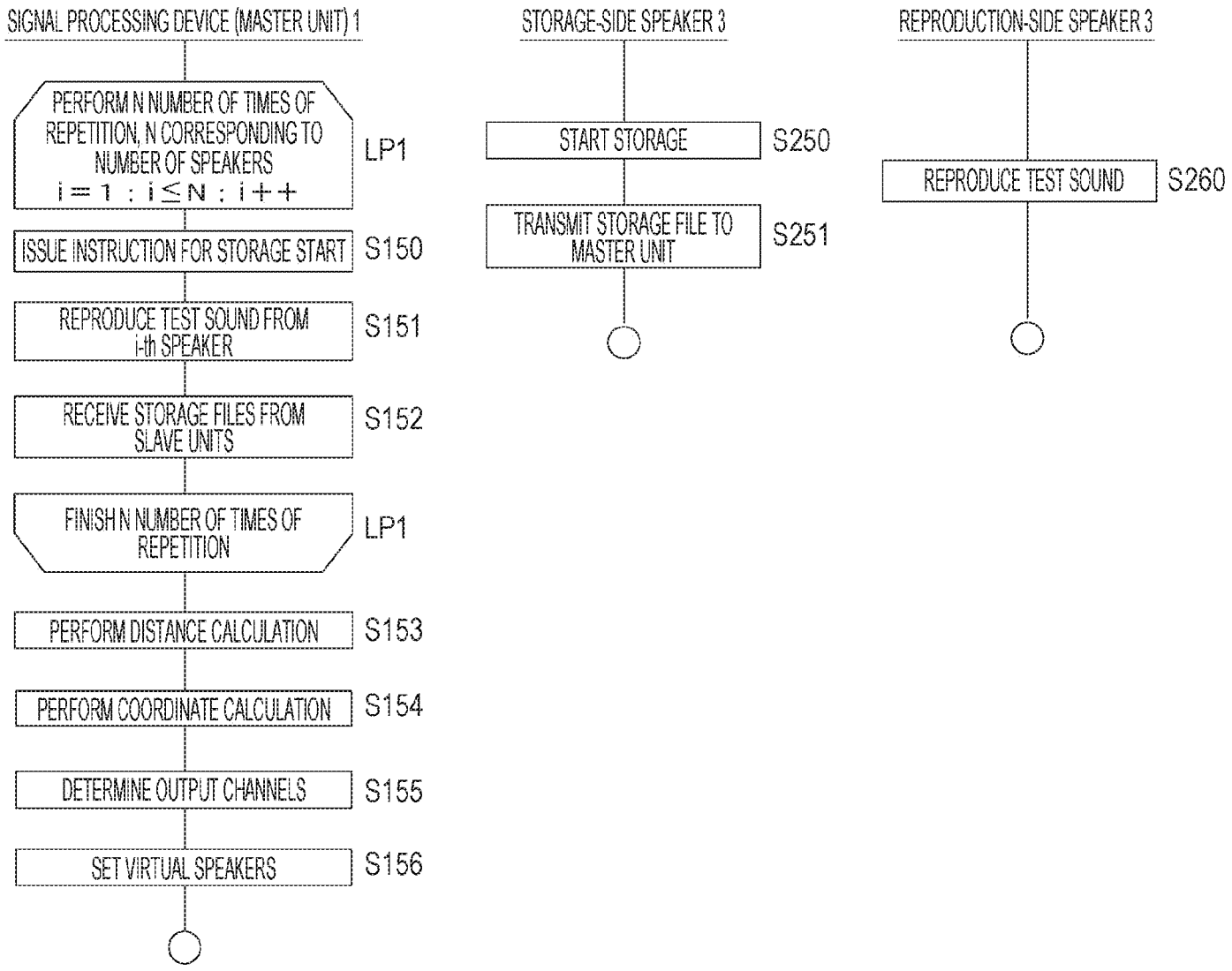
FIG. 11 is a flowchart of channel setting processing according to the embodiment.

FIG. 10 illustrates the processing of the signal processing device 1 on the left and the processing of each speaker 3 on the right. The processing of the signal processing device 1 is performed mainly by the functions of the relative-position recognition unit 11*a* and the channel setting unit 11*b* in the CPU 11. Moreover, the processing of each speaker 3 is indicated as the processing of the corresponding CPU 31.

Moreover, FIG. 10 illustrates the processing from the point in time initial setup starts after establishment of communication between the signal processing device 1 and each speaker 3.

In step S100, the CPU 11 of the signal processing device 1 issues an instruction for touch sensor on to all the speakers 3 that are slave units.

In accordance with the instruction, the CPU 31 of each of the speakers 3A, 3B, 3C, and 3D turns on the touch sensor 34 in step S201 to start the processing for a monitoring loop in steps S202 and S203. In step S202, the CPUs 31 each check the presence or absence of a user operation to the touch sensor 34. Moreover, in step S203, the CPUs 31 each check the presence or absence of an instruction for touch sensor off from the signal processing device 1.

After issuing the instruction for turning on the touch sensor 34, in step S102, the CPU 11 of the signal processing device 1 performs guidance control. That is, the CPU 11 performs control such that a guide output is performed to the user, such as "Please touch the speaker on the left facing the front". For example, a sound signal of such a message sound may be transmitted to part or all of the speakers 3 such that sound output is performed. Alternatively, in a case where the speakers 3 store guidance sound source data, the CPU 11 may instruct each CPU 31 to output a guidance sound based on the sound source data. Furthermore, the CPU 11 may instruct the monitor device 9 to perform guide display.

Then, in step S103, the CPU 11 waits for a notification from a slave unit (speaker 3).

In accordance with the guidance, the user touches the front left speaker 3, so that the CPU 31 of the speaker 3 arranged on the front left detects an operation to the touch sensor in step S202.

In that case, in step S204, the CPU 31 of the speaker 3 notifies the signal processing device 1 that is the master unit that a touch operation has been detected. Then, in step S205, the CPU 13 turns off the touch sensor.

After detecting, from a speaker 3, that the touch sensor 34 has detected an operation, the CPU 11 of the signal processing device 1 proceeds from step S103 to step S104 and issues an instruction for touch sensor off to each speaker.

This arrangement causes the CPU 31 of each speaker 3 to which a touch operation has not been performed to recognize the instruction for touch sensor off in step S203. Then, the CPU 31 of each speaker 3 proceeds to step S205 to turn off the touch sensor.

Subsequently, in step S105, the CPU 11 of the signal processing device 1 sets the speaker 3 having transmitted the effect that a touch operation has been detected, as the FL-channel speaker. For example, in the example of FIG. 6B, the speaker 3A has been set as the FL channel speaker.

Next, in step S106, the CPU 11 instructs each of the speakers 3B, 3C, and 3D different from the speaker 3A set, for example, to the FL channel, to turn on the touch sensor 34.

In this case, the CPU 11 of the FL speaker 3A does not particularly perform corresponding processing because the control is not performed to itself, but the other speakers 3B, 3C, and 3D each recognize the instruction for touch sensor on in step S201 again and then start the processing for a monitoring loop in steps S202 and S203.

After issuing the instruction for turning on the touch sensor 34 in step S106, in step S107, the CPU 11 of the signal processing device 1 performs second guidance control. That is, the CPU 11 performs control such that a guide output is performed to the user, such as "Please touch the speaker on the right facing the front". Then, in step S108, the CPU 11 waits for a notification from a slave unit (speaker 3).

In accordance with the guidance, the user touches the front right speaker 3, so that the CPU 31 of the speaker 3 arranged on the front right detects an operation to the touch sensor in step S202.

In that case, in step S204, the CPU 31 of the speaker 3 notifies the signal processing device 1 that is the master unit that a touch operation has been detected. Then, in step S205, the CPU 31 turns off the touch sensor.

After detecting, from a speaker 3, that the touch sensor 34 has detected an operation, the CPU 11 of the signal processing device 1 proceeds from step S108 to step S109 and issues an instruction for touch sensor off to each speaker.

This arrangement causes the CPU 31 of each speaker 3 to which a touch operation has not been performed to recognize the instruction for touch sensor off in step S203. Then, the CPU 31 of each speaker 3 proceeds to step S205 to turn off the touch sensor.

Subsequently, in step S110, the CPU 11 of the signal processing device 1 sets the speaker 3 having transmitted the effect that a touch operation has been detected, as the FR-channel speaker. For example, in the example of FIG. 6B, the speaker 3B has been set as the FR channel speaker.

Subsequently, the CPU 11 of the signal processing device 1 and the CPU 31 of each speaker 3 proceed to the processing of FIG. 11. FIG. 11 illustrates the processing of the CPU 11 on the left and the processing of the CPU 31 of a storage-side speaker 3 and the processing of the CPU 31 of a reproduction-side speaker 3 on the right.

Figure 7B:
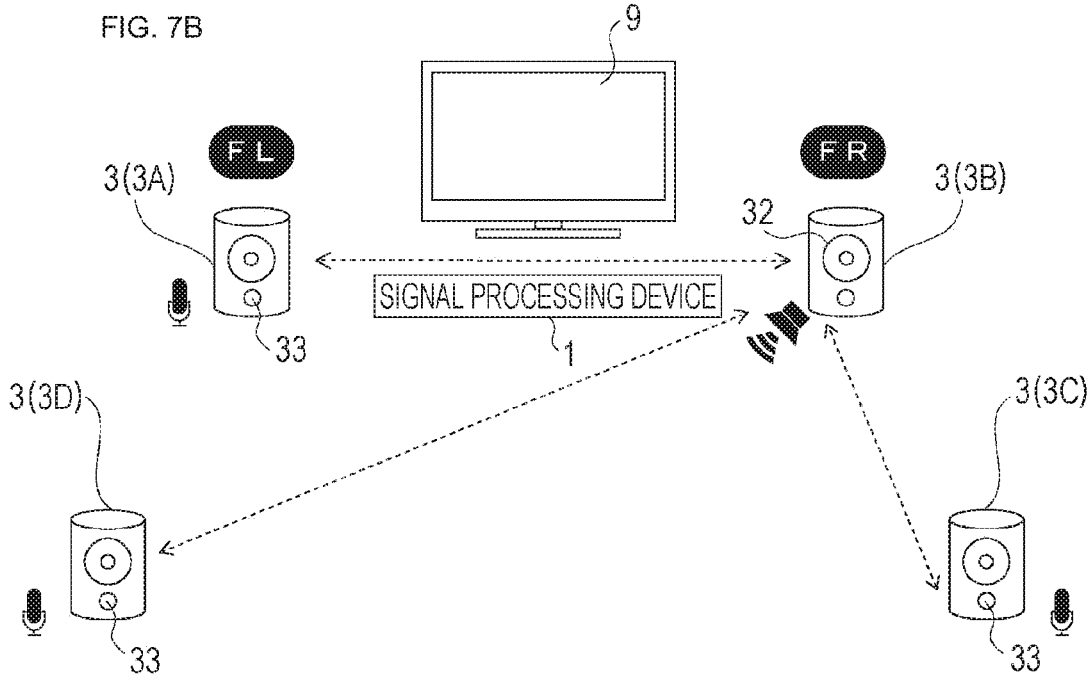

As described with FIGS. 7A and 7B, from here, every single speaker 3 in sequence outputs a test sound as a production-side speaker and the other three speakers 3 each store the sound and time information as a storage-side speaker.

Thus, the CPU 11 of the signal processing device 1 repeats the processing in steps S150, S151, and S152 as loop processing LP1 N number of times, the N corresponding to the number of speakers 3.

In step S150, the CPU 11 issues an instruction for storage start to a plurality of speakers 3 different from the i-th speaker 3.

Moreover, in step S151, the CPU 11 performs control such that the i-th speaker 3 reproduces a test sound, for example, at a designated time.

Furthermore, in step S152, the CPU 11 performs reception processing to information regarding a stored file from each of the plurality of speakers 3 different from the i-th speaker 3.

The CPU 11 repeats the above processing while incrementing the variable i sequentially.

Moreover, corresponding to such processing of the CPU 11, the CPU 31 of the i-th speaker 3 performs processing as a production-side speaker.

That is, in step S260, with reception of an instruction for test-sound reproduction based on step S151 on the signal processing device 1 side, the CPU 31 reproduces a test sound at the designated time.

The CPU 31 of each of the plurality of speakers 3 different from the i-th speaker 3 performs processing as a storage-side speaker. That is, in step S250, with reception of an instruction for storage start based on step S150 on the signal processing device 1 side, each CPU 31 starts storage of a sound that the microphone 33 inputs and time information.

Moreover, after finishing a predetermined time of storage, in step S251, each CPU 31 transmits the storage file to the signal processing device 1 that is the master unit.

For example, the reproduction time of a test sound that the reproduction-side speaker outputs is defined as a time length of 0.5 seconds.

For example, with reception of an instruction for storage start from the signal processing device 1, the storage-side speakers 3 each perform a predetermined period of audio sound storage, such as one second. Each frame included in the sound signal at this time includes a time stamp as the current time information. Then, for example, one second of sound signal storage file is generated, and then, in step S251, the generated storage file is transmitted to the signal processing device 1.

Therefore, when test-sound reproduction start time (or control timing) at which the CPU 11 issues an instruction to the reproduction-side speaker 3 and storage start time (or control timing) at which the CPU 11 issues an instruction to each storage-side speaker 3 are set properly, each storage file to be transmitted to the signal processing device 1 includes a first period in which no test sound is present (period including silence or ambient noise), a middle period in which a test sound is present, and a last period in which no test sound is present.

The CPU 11 of the signal processing device 1 that has received such a storage file specifies the first frame storing the test sound, so that the arrival time of the test sound at the speaker 3 can be detected from the time stamp of the frame.

Note that, as described above, the CPUs 31 each may analyze the storage start time of the test sound detected by the microphone 33, and may transmit only the time information to the information processing device 1.

The CPU 11 of the signal processing device 1 performs the loop processing LP1 four times, resulting in achievement of the operation described with FIGS. 7A and 7B.

Then, this arrangement enables the CPU 11 to detect the sound arrival time at each speaker 3 with reception of the storage files from the storage-side speakers 3 at each point in time.

In step S153, the CPU 11 calculates the distance between each speaker.

For example, when the speaker 3A is defined as a production-side speaker and the speakers 3B, 3C, and 3D are defined as storage-side speakers, the CPU 11 can calculate the sound arrival time between the speakers 3A and 3B, the sound arrival time between the speakers 3A and 3C, and the sound arrival time between the speakers 3A and 3D from the test-sound output start time of the speaker 3A and the storage files received from the speakers 3B, 3C, and 3D. Therefore, the distance between the speakers 3A and 3B, the distance between the speakers 3A and 3C, and the distance between the speakers 3A and 3D can be calculated.

Such calculation acquires the distance between each speaker 3.

In step S154, the CPU 11 performs coordinate calculation. Since the distance between each speaker 3 has been specified, the position of each speaker 3 is mapped on the coordinates such that the specified inter-speaker distances are expressed. Furthermore, since the FL speaker and the FR speaker have been specified, the speakers are defined to be arranged ahead.

This arrangement causes expression of the speaker arrangement relationship as in FIG. 8A on the coordinates.

Then, in step S155, the CPU 11 performs channel assignment in accordance with the positions of all the speakers 3.

As a result, channel automatic setting is completed.

After that, in step S156, virtual speaker setting may be performed.

Because the above processing is performed, for example, at the time of initial setup, the user can arrange the speakers 3 without caring about output channel setting to the speakers 3. Moreover, improper channel assignment can be prevented from being performed to the arrangement state of the speakers 3.

3. Speaker Arrangement Changing

Next, speaker arrangement changing in a case where virtual speaker setting is performed, will be described.

In general, a surround speaker system assumes that a user always listens facing in the same direction once setting is performed. In contrast to this, according to the present embodiment, use of virtual speakers 4 enables the user with a simple action to change the direction of listening arbitrarily.

Figure 12A:
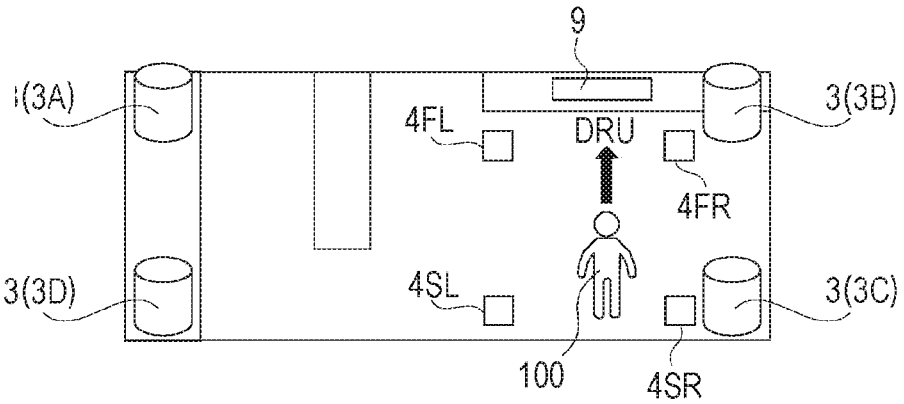
FIGS. 12A, 12B and 12C are explanatory views of speaker arrangement direction changing according to the embodiment.

FIG. 12A illustrates a model assumed as the interior of a room like a living dining kitchen. For example, the actual speakers 3A, 3B, 3C, and 3D are arranged at the corners as in the figure. In this state, virtual speakers 4 are set suitably to the listening position of the user 100 of FIG. 12A, namely, suitably to a case where the user 100 faces the monitor device 9 like an arrow DRU.

Note that, for the virtual speakers 4, virtual speakers 4FL, 4FR, 4SL, and 4SR will be given for indication of each channel.

In the state of FIG. 12A, the user 100 is under a proper surround audio environment.

Figure 12B:
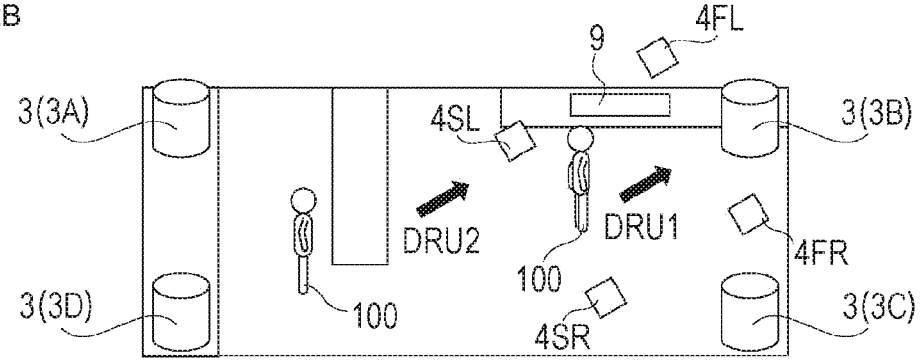

Meanwhile, as in FIG. 12B, assumed is the state where the user 100 faces in the direction of an arrow DRU 1 or the state where the listening direction of the user 100, who watches the monitor device 9 in the kitchen, is, for example, an arrow DRU 2. In that case, for example, the arrangement of the virtual speakers 4 as in FIG. 12A is no longer proper.

Thus, the arrangement of the virtual speakers 4FL, 4FR, 4SL, and 4SR is moved in the direction of rotation, for example, as illustrated in the figure.

Then, provided is a proper surround audio environment to the user 100 facing in the direction of the arrow DRU1. Moreover, even when the user 100 in the kitchen watches the monitor device 9 and faces in the direction of the arrow DRU 2, a relatively suitable audio environment is provided.

As described above, meeting the orientation of the user, preferably, the user can change (rotate) the arrangement of the virtual speakers 4 arbitrarily.

Thus, according to the present embodiment, an operation with the remote controller 5 enables the user to rotate the arrangement of the virtual speakers 4.

As illustrated in FIG. 3, the remote controllers 5A and 5B are provided with the respective operators 50 (50A and 50B) for rotational operation. The user performs a rotational operation with either operator 50. The user operates the operator 50 by an amount of rotation suitable to the orientation of the user.

In accordance with the operation, the speaker system according to the present embodiment changes the arrangement positions of the virtual speakers 4 by a designated amount of rotation.

FIGS. 13A, 13B, 13C, 13D, 13E, 13F, 13G, and 13H illustrate situations in which the arrangement of the virtual speakers 4 is rotated.

Figure 13A:
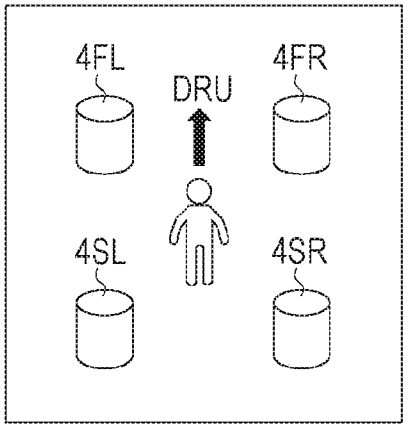

For example, FIG. 13A illustrates an arrangement state suitable to the user facing in the direction of the arrow DRU.

Figure 13B:
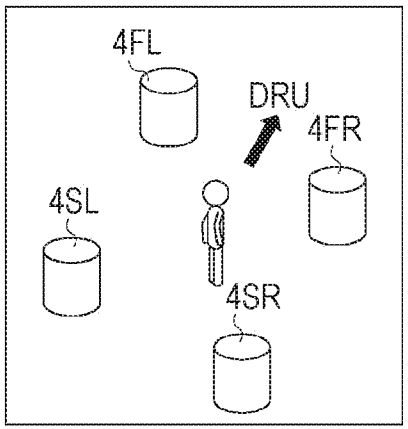
Figure 13C:
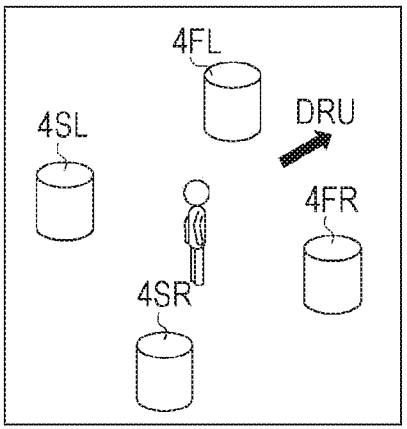
Figure 13D:
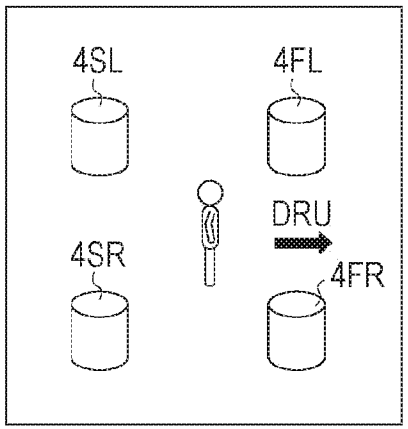

In accordance with a right-handed (clockwise) rotational operation of the user, the signal processing device 1 rotates the arrangement of the virtual speakers 4, for example, from FIG. 13B to FIG. 13C and from FIG. 13C to FIG. 13D. FIG. 13D illustrates the arrangement positions in FIG. 13A rotated by 90 degrees clockwise.

Figure 13E:
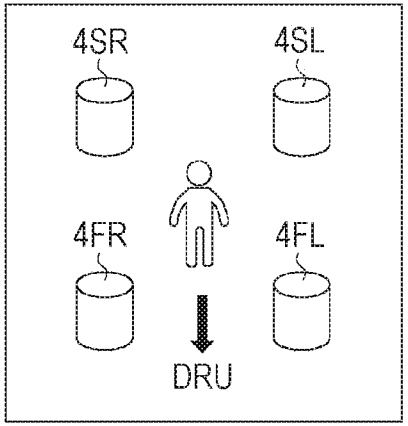
Figure 13F:
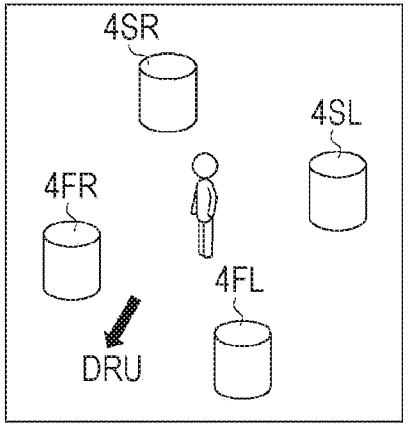
Figure 13F:
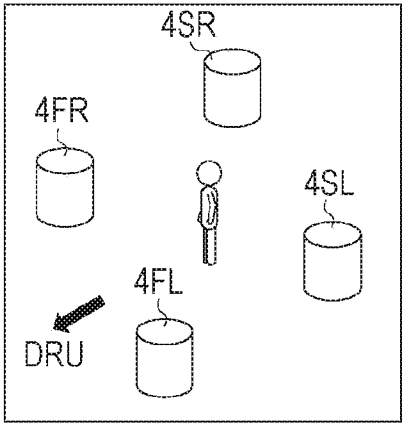
Figure 13H:
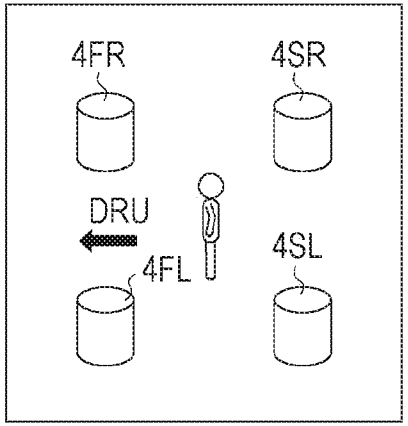

FIG. 13E illustrates the arrangement positions in FIG. 13D further rotated by 90 degrees clockwise. Moreover, in a case where the user performs a right-handed rotational operation from FIG. 13E, the signal processing device 1 rotates the arrangement of the virtual speakers 4, for example, from FIG. 13F to FIG. 13G and from FIG. 13G to FIG. 13H.

Needless to say, in a case where the user performs a left-handed (counterclockwise) rotational operation with the operator 50, in accordance with the operation, the signal processing device 1 rotates the arrangement of the virtual speakers 4 counterclockwise.

As described above, an operation of the user to the remote controller 5 causes the positions of the virtual speakers 4 to rotate every previously determined angle changing step.

Then, without moving the positions of the actual speakers 3, the direction of listening can be switched suitably to the direction indicated with the arrow DRU.

In this case, the angle changing step can be set freely in rate, and thus the direction of listening adaptable to the arrangement situation the speakers 3 is not limited.

Use of the mechanism enables the direction of listening to be easily changed meeting use cases different in the direction of listening, such as the time when the user listens sitting on a sofa and the time when the user listens in the kitchen, in the surround speaker system arranged in the living dining kitchen, for example, as illustrated in FIGS. 12A and 12B.

Figure 12C:
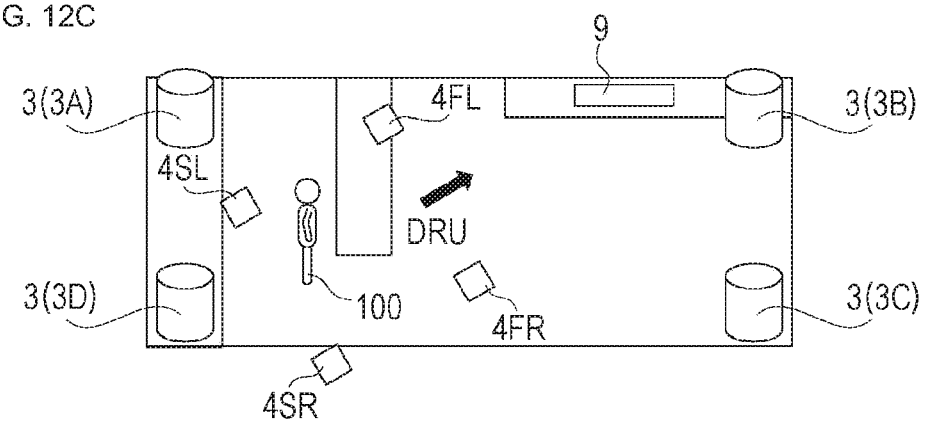

Note that, as in FIG. 12C, the virtual speakers 4 can be not only rotated but also shifted forward and backward. For example, for creation of a further suitable surround audio environment to the user 100 in the kitchen, a forward-and-backward operation or crosswise operation of the user may be allowed such that the state of FIG. 12B can be changed to the arrangement state of FIG. 12C.

Figure 14:
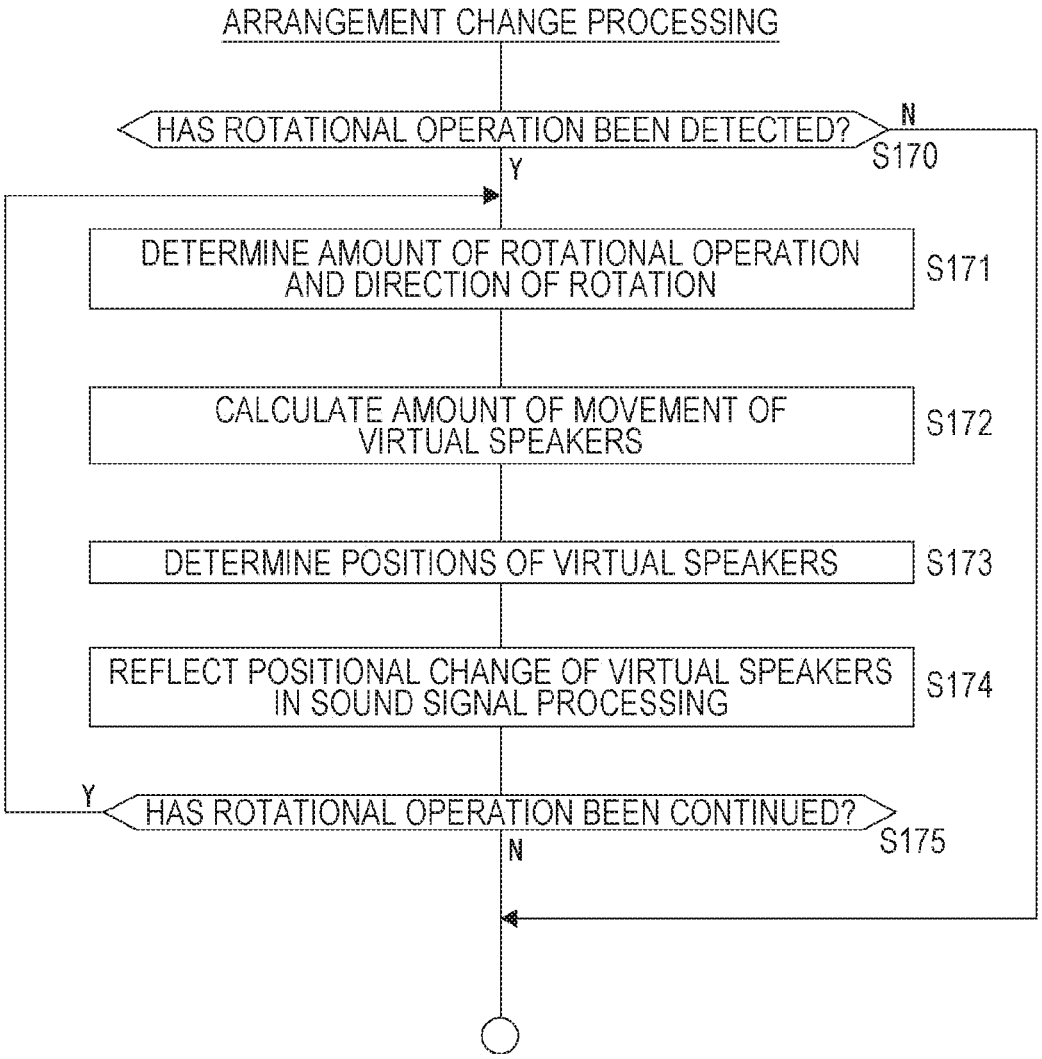
FIG. 14 is a flowchart of arrangement change processing according to the embodiment.

FIG. 14 illustrates exemplary processing of the CPU 11 of the signal processing device 1 for rotation of the arrangement state as in FIGS. 13A, 13B, 13C, 13D, 13E, 13F, 13G, and 13H. The processing of FIG. 14 is performed mainly by the virtual speaker setting unit 11*c* in the CPU 11.

In step S170, for example, the CPU 11 monitors a rotational operation of the user through the remote controller 5.

In a case where the rotational operation is detected, the CPU 11 proceeds from step S170 to step S171, and determines the amount of rotational operation and the direction of rotation in the operation per unit of time.

In step S172, from the amount of rotational operation, the CPU 11 calculates the amount of movement of the virtual speakers 4, namely, in this case, the angle of rotational movement of the virtual speakers 4. For example, the CPU 11 calculates by how many steps of angle rotation should be performed to the minimum step angle as the resolution of arrangement.

After determination of the angle of rotation, in step S173, the CPU 11 determines positions to which the virtual speakers 4 are to be changed. For example, on the coordinates, the positions (coordinate values) rotationally moved on the basis of the angle and the direction corresponding to the rotational operation are determined as new positions to the virtual speakers 4FL, 4FR, 4SL, and 4SR.

Then, in step S174, the CPU 11 controls signal processing such that a sound field is formed on the basis of the new positions of the virtual speakers 4FL, 4FR, 4SL, and 4SR.

That is coefficient changing, for example, for the localized state due to the mixing rate between the respective channel sound signals to be output to the speakers 3A, 3B, 3C, and 3D or for delay time setting is performed such that an audio space is created on the basis of the new positions of the virtual speakers 4FL, 4FR, 4SL, and 4SR with audio outputs of the actual speakers 3A, 3B, 3C, and 3D. This processing causes rotational movement of the virtual speakers 4.

In step S175, the CPU 11 verifies whether or not the rotational operation of the user has been performed continuously. In a case where the rotational operation has been performed continuously (e.g., a case where the operator 50A as a rotary encoder has been rotated continuously, or other cases), the CPU 11 goes back to step S171 and then performs similar processing.

In a case where the rotational operation has not been performed continuously, the CPU 11 finishes the processing of FIG. 14 from step S175. In a case where a rotational operation is detected again, the CPU 11 starts the processing of FIG. 14, again.

The above processing causes the arrangement of the virtual speakers 4 to be rotated in accordance with an operation of the user. This arrangement enables the user to change the arrangement of the virtual speakers 4 with a high degree of freedom, meeting the direction of listening of the user.

Note that, as in FIG. 12C, in a case where the arrangement of the virtual speakers 4 can be moved in the forward-and-backward direction and in the crosswise direction, similarly, it is sufficient that a new arrangement is set to the virtual speakers 4 in accordance with a forward-and-backward operation or crosswise operation of the user and then the processing of channel sound signals is changed in accordance with the new arrangement.

4. To-be-Used Speaker Changing

In the speaker system according to the embodiment, after completion of the above initial setup, the user selects an arbitrary speaker 3, so that switching can be performed between the mode in which sound is audible only from the selected speaker 3 and the mode in which sound is audible from all the speakers 3.

Figure 15A:
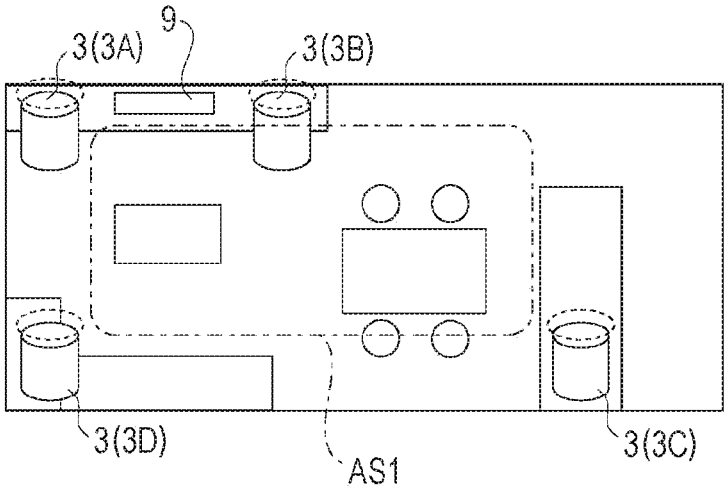
FIGS. 15A and 15B are explanatory views of to-be-used speaker selection according to the embodiment.
Figure 15B:
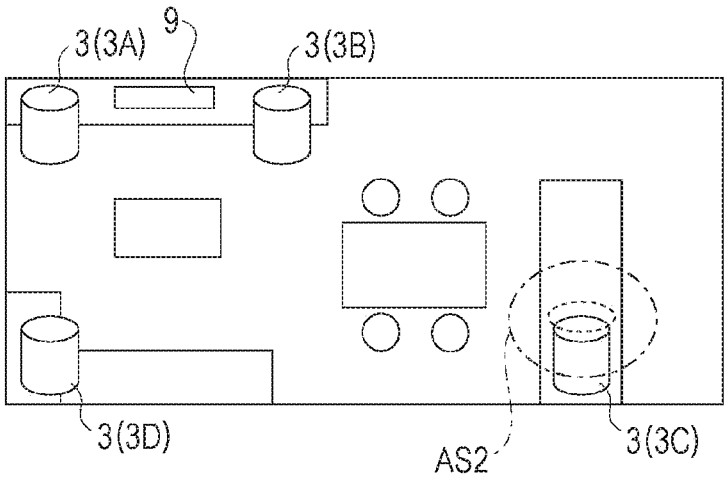

For example, FIG. 15A illustrates the state where all the speakers 3A, 3B, 3C, and 3D are used, and FIG. 15B illustrates the state where only the speaker 3C designated by the user is used.

For example, the state of FIG. 15A with an indoor wide area defined as a reproduction area AS1 is suitable for listening in an ordinary surround audio environment. Meanwhile, for example, there is a case where the user wants to listen to music or the like at a relatively small volume when the user is alone in the kitchen early in the morning and the like. In that case, designation of the speaker 3C arranged near the kitchen enables sound output suitable for listening in a reproduction area AS2 on the periphery of the kitchen as in FIG. 15B.

Note that, only for mutual switching between such a reproduction state with a single speaker and the surround reproduction state with all the speakers, it is troublesome to perform, for example, a switching operation with a smartphone or the like or a group creation/separation operation with an on-body button.

Moreover, for sound reproduction with a single speaker, it is difficult to intuitively select the speaker 3 right in front of the user.

Furthermore, it is troublesome to perform frequent switching between the modes.

Thus, according to the present embodiment, to-be-used speaker selection can be performed easily with an intuitive operation.

The speakers 3 each include the touch sensor 34. Thus, use of the touch sensor 34 enables designation of a to-be-used speaker and additionally switching between the use of all the speakers and the use of a single speaker.

For example, a long-press touch of the user to the touch sensor 34 enables a necessary operation.

Exemplary processing of the signal processing device 1 for the above, will be described with FIGS. 16 and 17.

Figure 16:
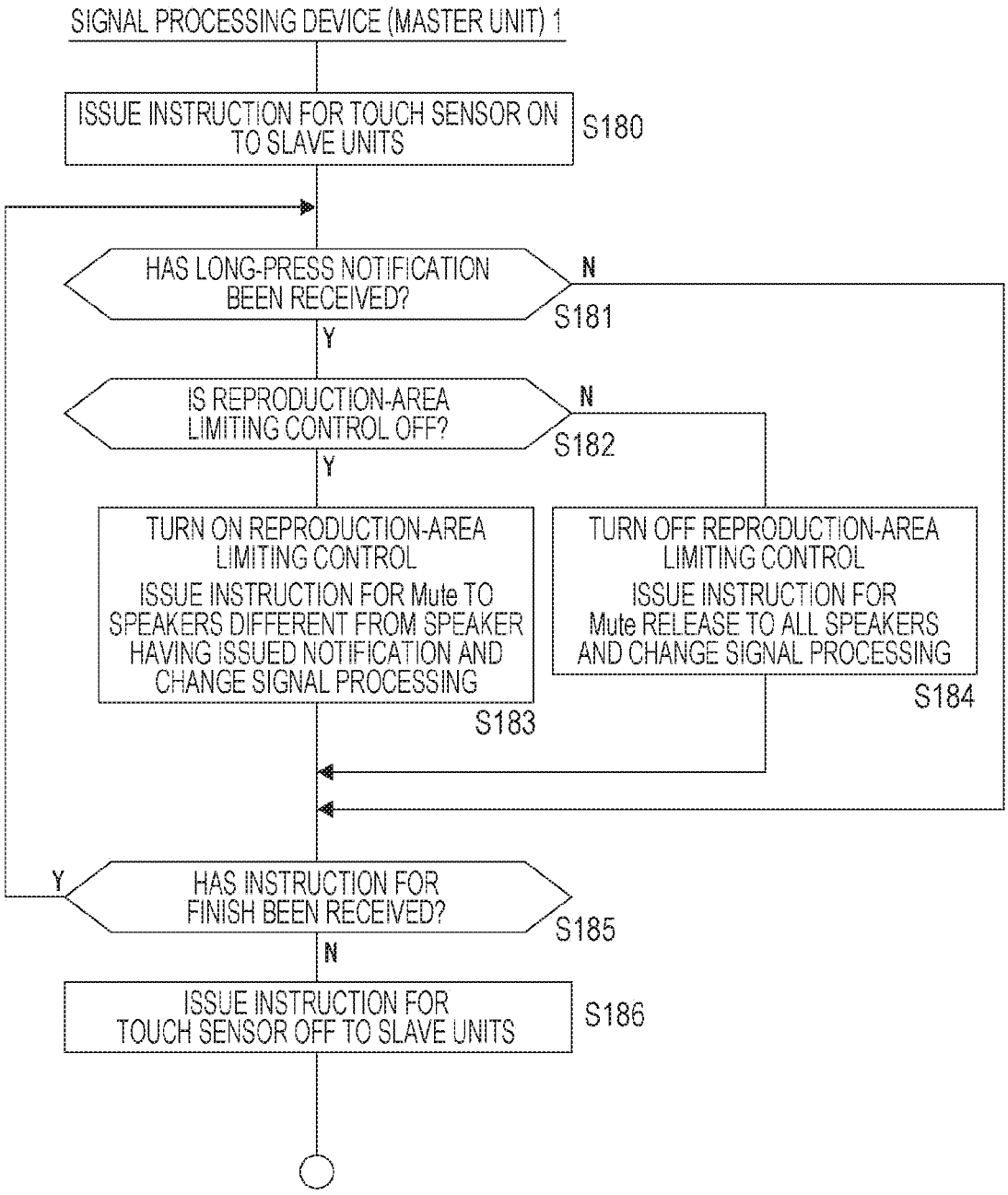
FIG. 16 is a flowchart of to-be-used speaker selection processing according to the embodiment.

FIG. 16 illustrates exemplary processing of the CPU 11 of the signal processing device 1. The CPU 11 performs the processing with the function as the to-be-used speaker setting unit 11*e*.

In step S180 of FIG. 16, the CPU 11 instructs all the speakers 3 (slave units) to turn on the respective touch sensors 34. Each speaker 3 turns on the touch sensor 34, in accordance with the instruction.

In step S181, the CPU 11 verifies whether or not a long-press notification has been received from any of the speakers 3.

In a case where no long-press notification has been received, the CPU 11 proceeds to step S185 and verifies an instruction for finish. The instruction for finish is, for example, an instruction for finishing sound output in the speaker system.

If no instruction for finish has been detected, verification of a long-press notification in step S181 is continued.

In a case where the user wants to switch from the ordinary state where the four speakers 3 are used to the state where only one close speaker 3 is used, the user performs a long-press operation to the touch sensor 34 of a close speaker 3. For example, the user keeps touching for a predetermined time or more, such as approximately one to two seconds.

In this case, the CPU 31 of the speaker 3 transmits a long-press notification to the signal processing device 1

In a case where a long-press notification has been received from a speaker 3, the CPU 11 proceeds from step S181 to step S182 and performs the processing, on the basis of whether reproduction-area limiting control is currently on or off.

The reproduction-area limiting control means limiting reproduction area narrowly with use of only part of the speakers 3 as in FIG. 15B.

When the reproduction-area limiting control is off, namely, in a case where ordinary surround audio reproduction is being performed with all the speakers 3, the CPU 11 proceeds to step S183 and turns on the reproduction-area limiting control. Thus, mute control is performed to each speaker 3 different from the speaker 3 having transmitted the long-press notification.

Moreover, control of changing channel signal processing is performed for switching to the state where only the speaker 3 having transmitted the long-press notification is used. For example, channel signal processing is changed such that a monaural sound signal is transmitted to the speaker 3 having transmitted the long-press notification.

This arrangement causes the CPU 31 of each speaker 3 having received the mute control (speakers 3 different from the speaker 3 subjected to a long press) to perform the mute control to its audio output. Sound output is thus stopped. Meanwhile, the signal processing device 1 transmits a monaural sound signal to the speaker 3 having transmitted the long-press notification. Therefore, acquired is the state where the monaural sound signal is output only from the speaker 3.

Note that, here, the supply of the monaural sound signal is exemplary. For example, in a case where one speaker 3 includes a plurality of speaker units 32 and performs stereo output solely, a sound signal having two channels of L and R may be generated so as to be supplied to the speaker 3.

In any case, acquired is the state where sound output is performed only from the speaker 3 subjected to a long-press touch of the user.

Moreover, in a case where the user wants to return from the state where the reproduction-area limiting control is being performed to the original surround audio environment, the user is only required to perform a long-press operation again.

In a case where it is determined in step S182 that the reproduction-area limiting control is currently being performed with detection of a long-press operation, in step S184, the CPU 31 turns off the reproduction-area limiting control.

Thus, mute release control is performed to all the speakers 3.

Moreover, control of changing channel signal processing is performed such that the present state is returned to the surround audio environment.

This arrangement causes the CPU 31 of each speaker 3 having received the mute-release control to release the mute control to its audio output. This arrangement causes the present state to return the state where all the speakers 3 perform sound output. Then, the signal processing device 1 transmits respective assigned channel sound signals to the speakers 3. Therefore, the present state is returned to the original surround audio environment.

In a case where an instruction for finish has been detected in step S185, in step S186, the CPU 31 instructs each speaker 3 to turn off the touch sensor 34, and then finishes the processing. In accordance with the instruction, each speaker 3 turns off the touch sensor 34.

Figure 17:
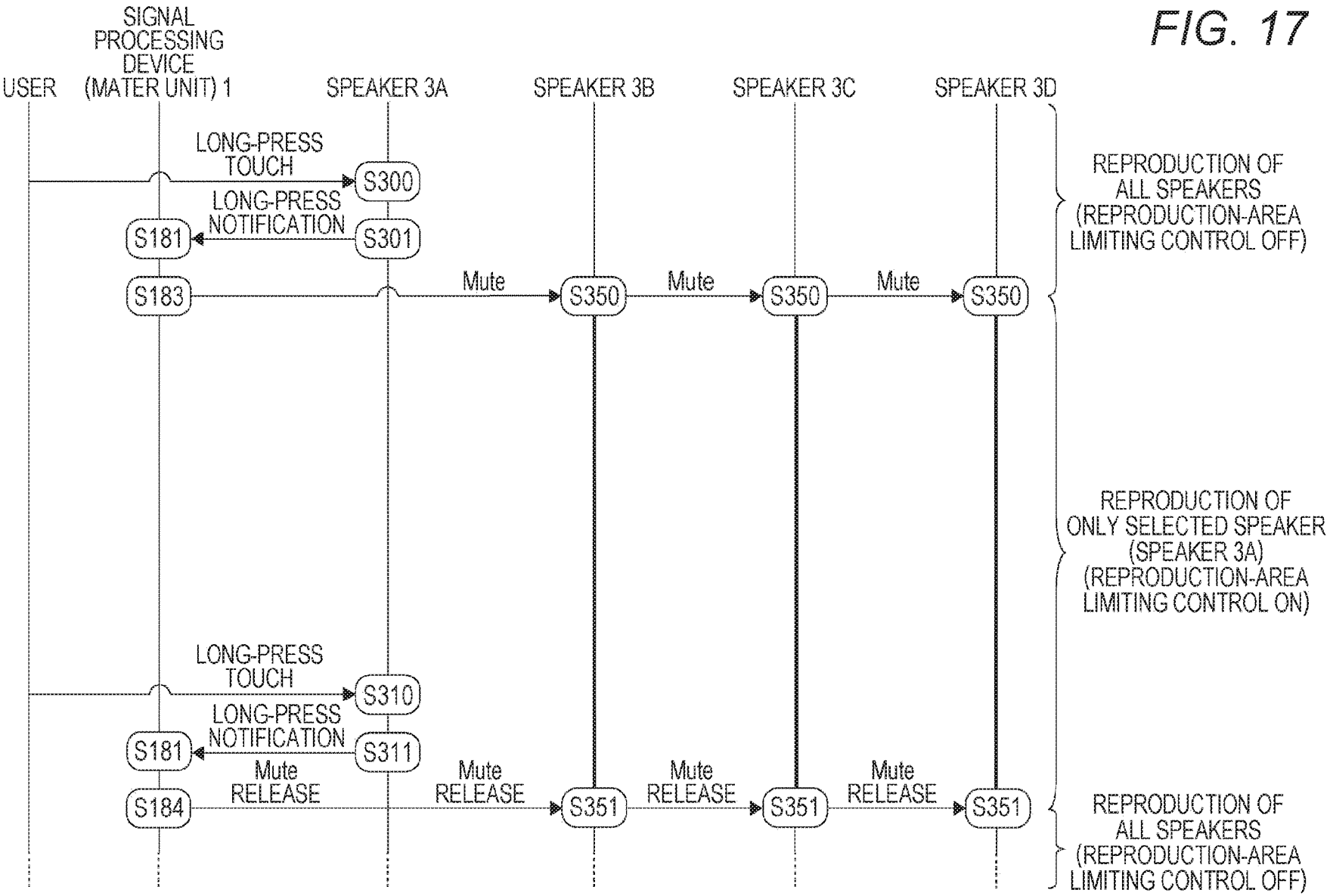
FIG. 17 is an explanatory sequence diagram of an operation of to-be-used speaker selection according to the embodiment.

The above processing is expressed on a time-series basis in FIG. 17.

FIG. 17 illustrates operations of the user and the operations of the signal processing device 1 (CPU 11) and the speakers 3A, 3B, 3C, and 3D.

For example, the user performs a long-press touch to the speaker 3A. The CPU 31 of the speaker 3A detects the long-press touch (S300), and issues a long-press notification to the signal processing device 1 (S301).

The CPU 11 of the signal processing device 1 detects the long-press notification in the processing in step S181, and performs the processing in step S183. That is, the CPU 11 of the signal processing device 1 transmits an instruction for mute to the speakers 3B, 3C, and 3D. In accordance with the instruction for mute, the CPU 31 of each of the speakers 3B, 3C, and 3D mutes its sound output (S350).

Only the speaker 3A performs sound output, on the basis of a sound signal from the signal processing device 1. This arrangement causes the reproduction-area limiting control to be turned on for use of the speaker 3A.

After that, for example, at a point in time, the user performs a long-press touch to the speaker 3A again.

This arrangement causes the CPU 31 of the speaker 3A to detect the long-press touch (S310), and then the CPU 31 of the speaker 3A issues a long-press notification to the signal processing device 1 (S311).

The CPU 11 of the signal processing device 1 detects the long-press notification in the processing in step S181, and next performs the processing in step S184. That is, the CPU 11 of the signal processing device 1 transmits an instruction for mute release to all the speakers 3A, 3B, 3C, and 3D. In accordance with the instruction for mute release, the CPU 31 of each of the speakers 3B, 3C, and 3D finishes the mute to its sound output (S351). Because the speaker 3A has not muted its sound output, the CPU 31 of the speaker 3A does not particularly need to follow the instruction for mute release.

Then, the signal processing device 1 transmits respective channel sound signals to the speakers 3. This arrangement causes resumption of reproduction of the surround audio system with the speakers 3A, 3B, 3C, and 3D, so that the reproduction-area limiting control is turned off.

Note that an operation at the time of release of the reproduction-area limiting control is not limited to a long-press touch to the speaker 3 in use, and may be a long-press touch to the other speakers 3. When the user wants to release the reproduction-area limiting control, the user is only required to perform a long-press touch to a close speaker 3. In that case, the CPU 31 proceeds to the processing in step S184, so that all the speakers 3 are released from the mute.

Note that, a processing example can be thought in which an operation for a case where the reproduction-area limiting control is turned off is limited to a touch operation to the speaker 3 in use.

As described above, the user performs a long-press touch to the touch sensor 34 provided on, for example, the top face of a speaker 3, so that toggle switching can be performed between the mode of reproduction only from the touched speaker 3 and the mode of reproduction from all the speakers.

Therefore, when the user wants reproduction only from the speaker 3 right in front of the user, the user performs an intuitive operation of simply touching the speaker 3 right in front of the user, resulting in switching to the state where sound is audible only from the speaker operated for selection.

Moreover, conversely, while reproduction is being performed only from a single speaker 3, the touch sensor 34 of an arbitrary speaker 3 is touched, resulting in simple switching to the mode of reproduction from all the speakers 3.

Figure 18:
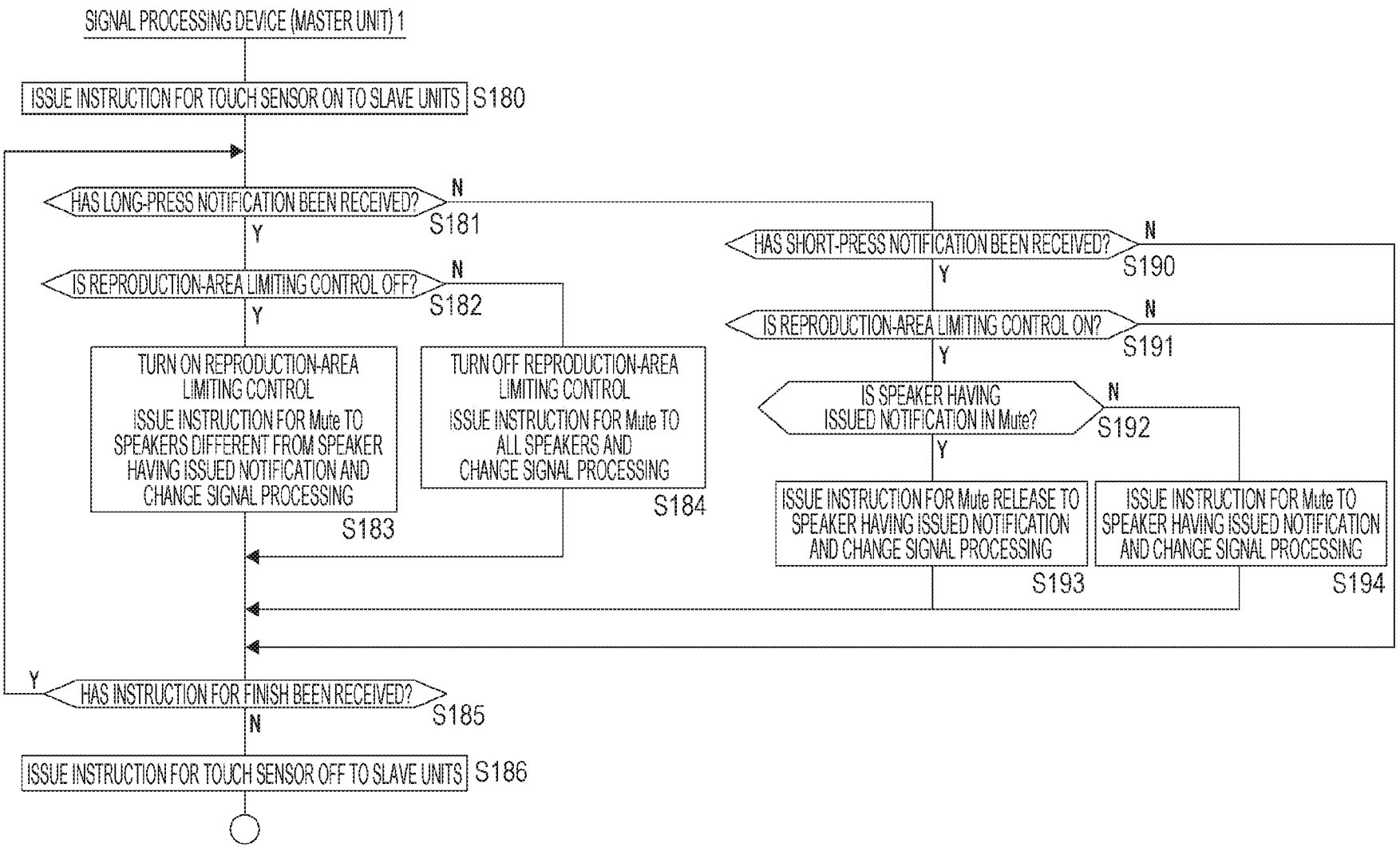
FIG. 18 is a flowchart of to-be-used speaker selection processing according to the embodiment.

FIG. 18 illustrates other exemplary processing of the CPU 11. Note that pieces of processing same as those in FIG. 16 are denoted with the same step numbers, and thus the descriptions thereof will be omitted. Steps S180 to S186 are the same as those in FIG. 16.

In the example of FIG. 18, the CPU 11 monitors a long-press notification in step S181 as well as a short-press notification in step S190. A short press is a touch operation for a short time, such as 100 ms or less, for example.

In a case where a short-press notification has been received from a speaker 3, the CPU 11 proceeds from step S190 to step S191 and performs the processing, on the basis of whether the reproduction-area limiting control is currently on or off. If the reproduction-area limiting control is off, the CPU 11 goes back to step S181 through step S185 with doing nothing particularly.

In a case where the reproduction-area limiting control is on in step S191, the CPU 11 proceeds to step S192 and verifies whether or not the speaker 3 having transmitted the short-press notification is a speaker in mute control.

In a case where the speaker 3 having transmitted the short-press notification is in mute control, the CPU 11 proceeds to step S193 and transmits an instruction for mute release to the speaker 3.

In accordance with the instruction, the CPU 31 of the speaker 3 having transmitted the short-press notification releases the mute, resulting in resumption of sound output.

Moreover, the CPU 11 of the signal processing device 1 changes channel signal processing such that sound output is performed with part of the speakers, the part being currently released from the mute.

This arrangement causes addition of the speaker 3 subjected to a short press of the user in reproduction-area limiting control, to sound reproduction.

Meanwhile, in a case where the short-press notification is transmitted from the speaker 3 not subjected to mute control, namely, the speaker 3 is performing output even in reproduction-area limiting control, the CPU 11 proceeds to step S194 and transmits an instruction for mute to the speaker 3.

In accordance with the instruction, the CPU 31 of the speaker 3 having transmitted the short-press notification resumes mute to stop the sound output.

Moreover, the CPU 11 of the signal processing device 1 changes channel signal processing so as to be suitable for sound output without the speaker 3 having received the instruction for mute.

This arrangement causes the speaker 3 performing reproduction in reproduction-area limiting control to be removed from the sound reproduction by a short press of the user.

Figure 19:
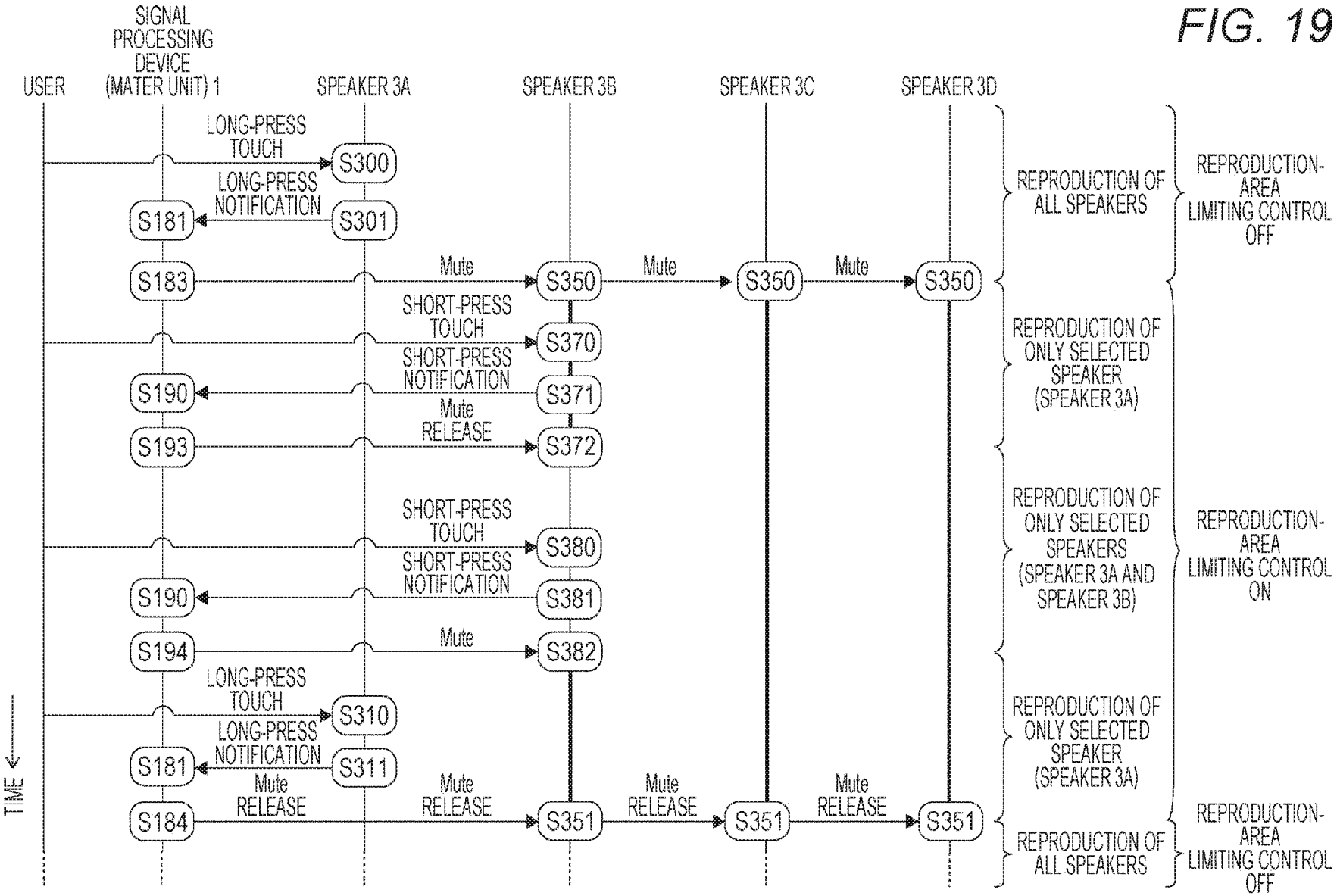
FIG. 19 is an explanatory sequence diagram of an operation of to-be-used speaker selection according to the embodiment.

The above processing is expressed on a time-series basis in FIG. 19. Similarly to FIG. 17, FIG. 19 illustrates operations of the user and the operations of the signal processing device 1 (CPU 11) and the speakers 3A, 3B, 3C, and 3D.

For example, the user performs a long-press touch to the speaker 3A. The CPU 31 of the speaker 3A detects the long-press touch (S300), and issues a long-press notification to the signal processing device 1 (S301).

The CPU 11 of the signal processing device 1 detects the long-press notification (S181) and transmits an instruction for mute to the speakers 3B, 3C, and 3D as the processing in step S183. In accordance with the instruction for mute, the CPU 31 of each of the speakers 3B, 3C, and 3D mutes its sound output (S350). That is, the reproduction-area limiting control is turned on for use of the speaker 3A.

After that, for example, at a point in time, the user performs a short-press touch to the speaker 3B.

When detecting the short-press touch (S370), the CPU 31 of the speaker 3B issues a short-press notification to the signal processing device 1 (S371).

The CPU 11 of the signal processing device 1 detects the short-press notification in step S190, and then performs the processing in step S193. That is, the CPU 11 of the signal processing device 1 issues an instruction for mute release to the speaker 3B. In accordance with the instruction, the CPU 31 of the speaker 3B releases the mute (S372).

Thus, acquired is the state where reproduction is performed with the speakers 3A and 3B.

Note that, although not illustrated, for example, a short-press touch is performed to the speaker 3C thereafter, so that the speaker 3C is also released from the mute. Thus, acquired is the state where reproduction is performed with the speakers 3A, 3B, and 3C.

After the speaker 3B is added to the reproduction, as illustrated in the drawing, for example, a short-press touch is performed to the speaker 3B again.

When detecting the short-press touch (S380), the CPU 31 of the speaker 3B issues a short-press notification to the signal processing device 1 (S381).

The CPU 11 of the signal processing device 1 detects the short-press notification in step S190, and performs, in this case, the processing in step S194. That is, the CPU 11 of the signal processing device 1 issues an instruction for mute to the speaker 3B. In accordance with the instruction, the CPU 31 of the speaker 3B performs mute control (S382).

This arrangement causes the state where reproduction is performed only with the speaker 3A, again.

After that, for example, the user performs a long-press touch to the speaker 3A.

This arrangement causes the CPU 31 of the speaker 3A to issue a long-press notification to the signal processing device 1 (S310).

The CPU 11 of the signal processing device 1 detects the long-press notification in the processing in step S181. In this time, in step S184, the CPU 11 of the signal processing device 1 transmits an instruction for mute release to all the speakers 3A, 3B, 3C, and 3D.

Then, the signal processing device 1 transmits respective channel sound signals to the speakers 3. This arrangement causes resumption of reproduction of the surround audio system with the speakers 3A, 3B, 3C, and 3D, so that the reproduction-area limiting control is turned off.

As described above, the reproduction-area limiting control of FIGS. 18 and 19 enables not only use of a single speaker 3 but also use of an arbitrary number of speakers that the user designates with a short-press touch.

This arrangement enables the user to intuitively and more freely select the state where part of the speakers 3 is used.

Note that a long-press touch and a short-press touch are provided above as aspects of operations of the user. Needless to say, such touches are not limitative.

Note that, for achievement of an intuitive selection operation, a speaker selection operation is preferably an operation of some kind performed to a speaker itself.

5. Summary and Modifications

According to the embodiment, the following effects are acquired.

With the function of the relative-position recognition unit 11*a*, the signal processing device 1 according to the embodiment performs: processing of recognizing two arrangement reference speakers (FL speaker and FR speaker) with reception of notification that a designation operation has been received from the user, from two speakers among N number of speakers 3, the N being three or more (S102 to S110 of FIG. 10); processing of acquiring distance information between each speaker 3 (S150 to S153 of FIG. 11); and processing of recognizing the relative-position relationship between the N number of speakers, with the two arrangement reference speakers and the distance information between each speaker (S154). Moreover, with the function of the channel setting unit 11*b*, the signal processing device 1 performs channel setting such that a channel is automatically set to each speaker 3, on the basis of the recognized relative-position relationship (S155).

In such channel setting processing, the signal processing device 1 first recognizes the FL speaker and the FR speaker as the arrangement reference speakers, so that, for example, the front direction of the user (listener) can be determined.

Moreover, acquisition of the distance information between each speaker 3 enables acquisition of the relative-position relationship between the N number of speakers 5.

Furthermore, because of the specification of the arrangement reference speakers, the actual speaker arrangement can be specified. Therefore, in accordance with the speaker arrangement, channel assignment can be automatically performed.

Along guidance, the user is only required to perform a designation operation, such as a touch, to the front left speaker 3 and the front right speaker 3 in sequence. Each speaker 3 arranged arbitrarily by the user is automatically assigned to a proper channel only by the operation. This arrangement achieves proper channel setting with no trouble to the user. Furthermore, even if the user has no knowledge about channels, intuitive operations of simply touching two speakers 3 enables proper channel setting. This arrangement enables formation of an environment enabling optimum audio reproduction with no burden to the user.

Moreover, the user does not need to perform, as operations, touch operations to all the speakers 3, resulting in a simple procedure.

The present technology is applicable to a speaker system that connects three or more speakers 3. For example, even in a case where the number of speakers to be connected increases to 10 to 20, the same operability enables simple and correct setting of output channels to all the speakers 3.

The signal processing device 1 according to the embodiment includes the channel signal processing unit (11*d* and 12) that performs signal processing to an input sound signal and generates N channels of sound signals to be supplied one to one to the N number of speakers 3. On the basis of the channels set by the channel setting unit 11*b*, the channel signal processing unit (11*d* and 12) generates N channels of sound signals as transmission signals one to one to the speakers 3.

This arrangement causes channel signal processing to be performed based on automatic channel assignment based on automatic recognition of the speaker positional relationship to be performed, resulting in achievement of proper surround audio output.

According to the embodiment, the N number of speakers 3 each include an operation detection unit (touch sensor 34) that detects a designation operation from the user. Then, the relative-position recognition unit 11*a* of the signal processing device 1 issues an instruction for activation of the operation detection unit to each speaker 3 (S100) and additionally recognizes, as an arrangement reference speaker, a speaker 3 having issued a notification of the operation detection unit having had detection during a period of activation (S102 to S110). That is, for specification of an arrangement reference speaker, the CPU 11 (relative-position recognition unit 11*b*) performs control such that the touch sensor 34 of each speaker 3 is temporarily activated.

This arrangement causes the touch sensors 34 of the speakers 3 to function when the CPU 11 needs to specify the FL speaker and the FR speaker as arrangement reference speakers. Therefore, the CPU 11 can recognize, as designation operations for the FL speaker and the FR speaker, notifications of the touch sensors 34 each having received an operation, at the time of need, such as initial setup.

Note that, at the time different from the time of need, for example, at the ordinary time different from the time of initial setup, if the touch sensors 34 each do not need to detect an operation, the speakers 3 each do not necessarily supply any power to the operation detection unit and perform operation detection processing. Thus, temporal activation is useful to power saving and reduction of load in processing.

Other aspects in which the user performs a designation operation can be thought.

For example, with respective gesture recognition sensors with which the speakers 3 are equipped, the user may designate a speaker 3 with a gesture operation.

In addition, it can be thought that each speaker 3 is provided with an operation detection unit including a sensing device of some kind, such as a button, a microphone, or an optical sensor.

Moreover, even in a case where no sensing device is provided, an operation can be thought in which successive switching is performed between the speakers 3 each output a test sound by, for example, operations to the remote controller 5 and a determination button is pressed when a desired speaker 3 outputs a test sound, to designate the speaker 3.

The signal processing device 1 according to the embodiment recognizes, as the front left speaker (FL speaker) and the front right speaker (FR speaker), the two arrangement reference speakers that have received the notification that a designation operation has been received from the user.

Determination of the front left speaker and the front right speaker enables determination of the orientation of the user at the time of listening. This arrangement enables determination of which arrangement state of two arrangement states in mirror symmetry is actual one, as speaker arrangements assumed, with the relative-position relationship between all the speakers grasped, so that a channel can be properly set to each speaker, on the basis of the front left and front right speakers 3.

Note that the FL speaker and the FR speaker are not necessarily provided as arrangement reference speakers. For example, the user may touch a surround speaker.

Note that, because at least the FL speaker and the FR speaker are present and the respective positions are easy for the user to find, it can be thought that the FL speaker and the FR speaker each are favorable to an instruction for touch operation to the user and hardly any wrong touch operation is performed. Thus, the FL speaker and the FR speaker are preferable as arrangement reference speakers.

According to the embodiment, the two arrangement reference speakers are distinguished as the front left speaker and the front right speaker in order of designation operations from the user.

In order of operations of the user to the touch sensors 34, the front left speaker and the front right speaker can be discriminated clearly. This arrangement enables accurate specification of the FL speaker and the FR speaker even in a case where each speaker 3 is identical in configuration and transmits an identical touch sensor detection signal.

According to the embodiment, in a case where a first designation operation is performed by the user, an instruction for activation of the operation detection unit is issued to each speaker 3 different from the speaker 3 having transmitted a notification of the designation operation, and a second designation operation is waited for (S106 to S108).

This arrangement enables, in a case where the user touches the same speaker 3 two times, prevention of the speaker 3 from transmitting a needless notification to the signal processing device 1.

According to the embodiment, in order to acquire the distance information between each speaker 3, each speaker is caused to output a test sound in sequence (LP1: S150 to S152 of FIG. 11).

This arrangement enables measurement of the arrival time of a sound from one speaker to each speaker, so that the inter-speaker distances can be calculated.

According to the embodiment, all the speakers 3 are synchronized in time, and each speaker 3 includes the microphone 33 and is capable of transmitting detection time information regarding the test sound from each of the other speakers 3. From output start time information regarding the test sound from a speaker 3 and the detection time information from each of the other speakers, the signal processing device 1 calculates the distances between the one speaker and the other speakers (S153). This arrangement enables accurate calculation of the inter-speaker distances.

The signal processing device 1 according to the embodiment includes the virtual speaker setting unit 11*c* that sets the arrangement of virtual speakers 4, on the basis of the relative-position relationship recognized by the relative-position recognition unit 11*a* and the channel setting performed by the channel setting unit 11*b*.

Setting the virtual speakers 4 enables formation of an audio space simulating output with the virtual speakers, different from the actual speaker arrangement.

Moreover, the system that generates the virtual speakers 4 enables installation of the actual speakers 3 at various positions. However, in some cases, depending on the installed positions of the speakers 3, the user may be unsure which channels should be selected, resulting in extreme difficulty in channel setting. According to channel setting in the present embodiment, even in a case where the virtual speakers 4 are used, for example, it is sufficient that two speakers 3 placed on both sides of the monitor device 9 are selected. Thus, difficulty in channel setting due to speaker installed positions vanishes.

According to the embodiment, in a case where the arrangement of the virtual speakers 4 is set, the channel signal processing unit (11*d* and 12) generates, as respective transmission signals to the speakers 3, N channels of sound signals with which the virtual speaker arrangement is achieved.

That is the respective channel sound signals to be transmitted to the actual speakers 3 are subjected to processing such that the position of audio output and the localized state of each virtual speaker are achieved in accordance with the virtual speaker setting.

This arrangement causes sound output from the actual speakers to form an audio space in the virtual speaker arrangement. Therefore, even in a case where speaker arrangement in which optimum surround effect is not acquired is made due to, for example, the speaker arrangement positions corresponding to, for example, the indoor shape, the taste of the user, or the arrangement of furniture, a proper audio space can be provided to the user.

According to the embodiment, the example in which the virtual speaker setting unit 11*c* displaces the arrangement positions of the virtual speakers 4 in the direction of rotation in accordance with an operation signal, has been given (refer to FIG. 14).

For example, the arrangement positions of the virtual speakers are displaced in the direction of left-handed rotation or in the direction of right-handed rotation, in accordance with a rotational operation in the direction of left-handed/right-handed rotation of the user.

This arrangement enables provision of an audio space in which the virtual speakers are arranged with the directivity that the user desires. In accordance with, for example, the posture or orientation of the user or the location of the user in a room, an optimum surround audio space can be provided.

Needless to say, even without movement of the positions of the actual speakers 3 installed, the direction of listening can be easily changed meeting user' usage scene.

Note that an operation of the user is not limited to a rotational operation. For example, a button operation or a directional operation is assumed.

The example in which the signal processing device 1 according to the embodiment includes the to-be-used speaker setting unit 11*e* that controls, in accordance with a user operation, switching between audio output with the N number of speakers and audio output with part of the N number of speakers, has been given (refer to FIGS. 16 to 19).

This arrangement enables provision of an audio space in a state that the user desires. In accordance with, for example, the location of the user, the period of time, or the status of user's family, optimum audio output can be provided with a simple operation.

According to the embodiment, specifically, without an operation with a smartphone or the like, the reproduction area meeting user's usage scene can be controlled simply by direct selection of the speaker right in front of the user.

A program according to the embodiment causes, for example, a CPU, a digital signal processor (DSP), or the like to perform the functions as the relative-position recognition unit 11*a*, the channel setting unit 11*b*, the virtual speaker setting unit 11*c*, the channel signal processing unit 11*d*, and the to-be-used speaker setting unit 11*e*, or causes an information processing device as a device including the units to perform the functions.

That is, the program according to the embodiment causes the information processing device to perform: processing of recognizing two arrangement reference speakers with reception of notification that a designation operation has been received from the user, from two speakers among N number of speakers, the N being three or more; processing of acquiring distance information between each speaker; processing of recognizing the relative-position relationship between the N number of speakers, with the two arrangement reference speakers and the distance information between each speaker; and processing of automatically setting a channel to each speaker, on the basis of the recognized relative-position relationship.

Such a program enables achievement of the signal processing device 1 according to the present disclosure.

Such a program can be in advance recorded on a hard disk drive (HDD) as a recording medium built in equipment, such as a computer device, a ROM in a microcomputer including a CPU, or the like.

Moreover, such a program can be temporarily or permanently stored (recorded) in a removable recording medium, such as a flexible disk, a compact disc read only memory (CD-ROM), a magnet optical (MO) disc, a digital versatile disc (DVD), a Blu-ray Disc (registered trademark), a magnetic disk, a semiconductor memory, or a memory card. Such a removable recording medium can be provided as so-called packaged software.

Moreover, such a program can be downloaded from a download site through a network, such as a local area network (LAN) or the Internet, in addition to being installed from a removable recording medium to, for example, a personal computer.

Moreover, such a program is suitable to extensive provision of the signal processing device 1 according to the embodiment.

For example, downloading such a program to various types of equipment including an arithmetic processing device, such as audio equipment, a personal computer, a mobile information processing device, a mobile phone, game equipment, video equipment, and a personal digital assistant (PDA), enables the various types of equipment to be provided as the signal processing device 1 according to the present disclosure.

Note that the effects described in the present specification are just exemplary and are not limitative, and thus other effects may be provided.

Note that the present technology can have the following configurations.

(1)

A signal processing device including:

a relative-position recognition unit configured to perform processing of recognizing two arrangement reference speakers with reception of notification that a designation operation has been received from a user, from two speakers among N number of speakers, the N being three or more, and processing of acquiring distance information between each speaker, the relative-position recognition unit being configured to recognize a relative-position relationship between the N number of speakers, with the two arrangement reference speakers and the distance information between each speaker; and a channel setting unit configured to automatically set a channel to each speaker, on the basis of the relative-position relationship recognized by the relative-position recognition unit.

(2)

The signal processing device according to (1) above, further including:

a channel signal processing unit configured to perform signal processing to an input sound signal and generate N channels of sound signals to be supplied one to one to the N number of speakers, in which the channel signal processing unit generates the N channels of sound signals as transmission signals one to one to the speakers, on the basis of the channels set by the channel setting unit.

(3)

The signal processing device according to (1) or (2) above, in which the N number of speakers each include an operation detection unit that detects a designation operation from the user, and the relative-position recognition unit issues an instruction for activation of the operation detection unit to each speaker, and additionally recognizes, as an arrangement reference speaker, a speaker having issued a notification of the operation detection unit having had detection during a period of activation.

(4)

The signal processing device according to (3) above, in which the relative-position recognition unit recognizes, as a front left speaker and a front right speaker, the two arrangement reference speakers that have received the notification that the designation operation has been received from the user.

(5)

The signal processing device according to (4) above, in which the relative-position recognition unit distinguishes the two arrangement reference speakers as the front left speaker and the front right speaker in order of the designation operations from the user.

(6)

The signal processing device according to (5) above, in which the relative-position recognition unit issues, in a case where a first designation operation is performed by the user, the instruction for activation of the operation detection unit to each speaker different from a speaker having transmitted a notification of the first designation operation, and waits for a second designation operation.

(7)

The signal processing device according to any of (1) to (6) above, in which the relative-position recognition unit causes, for acquisition of the distance information between each speaker, each speaker sequentially to output a test sound.

(8)

The signal processing device according to (7) above, in which all the speakers are synchronized in time, each speaker includes a sound detection unit and is capable of transmitting detection time information regarding the test sound from another speaker, and the relative-position recognition unit calculates, from output start time information regarding the test sound from a speaker and detection time information from another speaker, a distance between the speaker and the another speaker.

(9)

The signal processing device according to any of (1) to (8) above, further including:

a virtual speaker setting unit configure to set a virtual speaker arrangement, on the basis of the relative-position relationship recognized by the relative-position recognition unit and the channel setting performed by the channel setting unit.

(10)

The signal processing device according to (9) above, further including, a channel signal processing unit configured to perform signal processing to an input sound signal and generate N channels of sound signals to be supplied one to one to the N number of speakers, in which the channel signal processing unit generates, in a case where the virtual speaker arrangement is set by the virtual speaker setting unit, the N channels of sound signals with which the virtual speaker arrangement is achieved, as transmission signals one to one to the speakers.

(11)

The signal processing device according to (9) or (10) above, in which the virtual speaker setting unit displaces position of the virtual speaker arrangement in a direction of rotation, in accordance with an operation signal.

(12)

The signal processing device according to any of (1) to (11), further including:

a to-be-used speaker setting unit configured to control switching between audio output with the N number of speakers and audio output with part of the N number of speakers, in accordance with a user operation.

(13)

A channel setting method to be performed by a signal processing device, the channel setting method including:

recognizing two arrangement reference speakers with reception of notification that a designation operation has been received from a user, from two speakers among N number of speakers, the N being three or more;

acquiring distance information between each speaker;

recognizing a relative-position relationship between the N number of speakers, with the two arrangement reference speakers and the distance information between each speaker; and automatically setting a channel to each speaker, on the basis of the relative-position relationship recognized.

(14)

A program causing an information processing device to perform:

processing of recognizing two arrangement reference speakers with reception of notification that a designation operation has been received from a user, from two speakers among N number of speakers, the N being three or more;

processing of acquiring distance information between each speaker;

processing of recognizing a relative-position relationship between the N number of speakers, with the two arrangement reference speakers and the distance information between each speaker; and processing of automatically setting a channel to each speaker, on the basis of the relative-position relationship recognized.

(15)

A speaker system including:

N number of speakers, the N being three or more; and a signal processing device capable of communicating with each speaker, in which the signal processing device includes:

a relative-position recognition unit configured to perform processing of recognizing two arrangement reference speakers with reception of notification that a designation operation has been received from a user, from two speakers among the N number of speakers, and processing of acquiring distance information between each speaker, the relative-position recognition unit being configured to recognize a relative-position relationship between the N number of speakers, with the two arrangement reference speakers and the distance information between each speaker; and a channel setting unit configured to automatically set a channel to each speaker, on the basis of the relative-position relationship recognized by the relative-position recognition unit.

REFERENCE SIGNS LIST

1 Signal processing device
3 Speaker
4 Virtual speaker
5 Remote controller
11, 31 CPU
11*a* Relative-position recognition unit
11*b* Channel setting unit
11*c* Virtual speaker setting unit
11*d* Channel signal processing unit
11*e* To-be-used speaker setting unit
12 Output signal formation unit
13, 35 RF module
14 Reception unit
32 Speaker unit
33 Microphone
34 Touch sensor

The invention claimed is:

1. A signal processing device, comprising:

a relative-position recognition unit configured to:

transmit a first instruction to each of a plurality of speakers, wherein the plurality of speakers includes at least three speakers, each of the plurality of speakers includes an operation detection unit, and the first instruction indicates a first period of activation of the operation detection unit of each of the plurality of speakers;

receive a first notification from a first speaker of the plurality of speakers, wherein the first notification indicates reception, in the first period of activation, of a first user designation operation on the first speaker;

transmit a second instruction to the plurality of speakers other than the first speaker, wherein the second instruction indicates a second period of activation of the operation detection unit of each of the plurality of speakers other than the first speaker;

receive a second notification from a second speaker of the plurality of speakers other than the first speaker, wherein the second notification indicates reception, in the second period of activation, of a second user designation operation on the second speaker;

recognize, based on an order of the reception of the first notification and the second notification, the first speaker as a front left speaker and the second speaker as a front right speaker;

acquire distance information between each of the plurality of speakers; and recognize a relative-position relationship between the plurality of speakers based on:

the recognition of the first speaker as the front left speaker and the second speaker as the front right speaker, and the distance information between each of the plurality of speakers; and a channel setting unit configured to set a channel to each of the plurality of speakers based on the recognized relative-position relationship.

2. The signal processing device according to claim 1, further comprising:

a channel signal processing unit configured to:

execute a signal process on an input sound signal;

generate a plurality of channels of sound signals to be supplied to the plurality of speakers; and generate, based on the channel set to each of the plurality of speakers, the plurality of channels of sound signals as transmission signals to the plurality of speakers.

3. The signal processing device according to claim 1, wherein the relative-position recognition unit is further configured to wait for the second user designation operation based on the transmission of the second instruction.

4. The signal processing device according to claim 1, wherein the relative-position recognition unit is further configured to control, for acquisition of the distance information between each of the plurality of speakers, each of the plurality of speakers sequentially to output a test sound.

5. The signal processing device according to claim 4, wherein each of the plurality of speakers is synchronized in time, the first speaker includes a sound detection unit, the sound detection unit transmits detection time information regarding the test sound from the second speaker, the second speaker is different from the first speaker, and the relative-position recognition unit is further configured to calculate, based on output start time information regarding the test sound from the second speaker and the detection time information from the first speaker, a distance between the first speaker and the second speaker.

6. The signal processing device according to claim 1, further comprising a virtual speaker setting unit configured to set a virtual speaker arrangement, based on the recognized relative-position relationship and the channel set to each of the plurality of speakers.

7. The signal processing device according to claim 6, further comprising a channel signal processing unit configured to:

execute a signal process on an input sound signal;

generate a plurality of channels of sound signals to be supplied to the plurality of speakers; and generate, based on the virtual speaker arrangement set by the virtual speaker setting unit, the plurality of channels of sound signals as transmission signals to the plurality of speakers.

8. The signal processing device according to claim 6, wherein the virtual speaker setting unit is further configured to displace, based on an operation signal, a position of the virtual speaker arrangement in a user direction of rotation.

9. The signal processing device according to claim 1, further comprising a to-be-used speaker setting unit configured to control, based on a specific user operation, switch between audio output with the plurality of speakers and audio output with a part of the plurality of speakers.

10. A signal processing method, comprising:

in a signal processing device:

transmitting a first instruction to each of a plurality of speakers, wherein the plurality of speakers includes at least three speakers, each of the plurality of speakers includes an operation detection unit, and the first instruction indicates a first period of activation of the operation detection unit of each of the plurality of speakers;

receiving a first notification from a first speaker of the plurality of speakers, wherein the first notification indicates reception, in the first period of activation, of a first user designation operation on the first speaker;

transmitting a second instruction to the plurality of speakers other than the first speaker, wherein the second instruction indicates a second period of activation of the operation detection unit of each of the plurality of speakers other than the first speaker;

receiving a second notification from a second speaker of the plurality of speakers other than the first speaker, wherein the second notification indicates reception, in the second period of activation, of a second user designation operation on the second speaker;

recognizing, based on an order of the reception of the first notification and the second notification, the first speaker as a front left speaker and the second speaker as a front right speaker;

acquiring distance information between each of the plurality of speakers;

recognizing a relative-position relationship between the plurality of speakers based on:

the recognition of the first speaker as the front left speaker and the second speaker as the front right speaker, and the distance information between each of the plurality of speakers; and setting a channel to each of the plurality of speakers based on the recognized relative-position relationship.

11. A non-transitory computer-readable medium having stored thereon computer-executable instructions that, when executed by a computer, cause the computer to execute operations, the operations comprising:

transmitting a first instruction to each of a plurality of speakers, wherein the plurality of speakers includes at least three speakers, each of the plurality of speakers includes an operation detection unit, and the first instruction indicates a first period of activation of the operation detection unit of each of the plurality of speakers;

receiving a first notification from a first speaker of the plurality of speakers, wherein the first notification indicates reception, in the first period of activation, of a first user designation operation on the first speaker;

transmitting a second instruction to the plurality of speakers other than the first speaker, wherein the second instruction indicates a second period of activation of the operation detection unit of each of the plurality of speakers other than the first speaker;

receiving a second notification from a second speaker of the plurality of speakers other than the first speaker, wherein the second notification indicates reception, in the second period of activation, of a second user designation operation on the second speaker;

recognizing, based on an order of the reception of the first notification and the second notification, the first speaker a front left speaker and the second speaker as a front right speaker;

acquiring distance information between each of the plurality of speakers;

recognizing a relative-position relationship between the plurality of speakers based on:

the recognition of the first speaker as the front left speaker and the second speaker as the front right speaker, and the distance information between each of the plurality of speakers; and setting a channel to each of the plurality of speakers based on the recognized relative-position relationship.

12. A speaker system, comprising:

a plurality of speakers, wherein the plurality of speakers includes at least three speakers, and each of the plurality of speakers includes an operation detection unit configured to receive a user designation operation; and a signal processing device configured to communicate with each of the plurality of speakers, wherein the signal processing device includes:

a relative-position recognition unit configured to:

transmit a first instruction to each of the plurality of speakers, wherein the first instruction indicates a first period of activation of the operation detection unit of each of the plurality of speakers;

receive a first notification from a first speaker of the plurality of speakers, wherein the first notification indicates reception, in the first period of activation, of a first user designation operation on the first speaker;

transmit a second instruction to the plurality of speakers other than the first speaker, wherein the second instruction indicates a second period of activation of the operation detection unit of each of the plurality of speakers other than the first speaker;

receive a second notification from a second speaker of the plurality of speakers other than the first speaker, wherein the second notification indicates reception, in the second period of activation, of a second user designation operation on the second speaker;

recognize, based on an order of the reception of the first notification and the second notification, the first speaker as a front left speaker and the second speaker as a front right speaker;

acquire distance information between each of the plurality of speakers, and recognize a relative-position relationship between the plurality of speakers based on:

the recognition of the first speaker as the front left speaker and the second speaker as the front right speaker, and the distance information between each of the plurality of speakers; and a channel setting unit configured to set a channel to each of the plurality of speakers based on the recognized relative-position relationship.

* * * * *